US008419008B2

(12) United States Patent
Ikeda et al.

(10) Patent No.: US 8,419,008 B2
(45) Date of Patent: Apr. 16, 2013

(54) IMAGE FORMING APPARATUS

(75) Inventors: Taro Ikeda, Tokyo (JP); Yuji Yamanaka, Toride (JP); Kazuhiro Kosuga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 12/691,253

(22) Filed: Jan. 21, 2010

(65) Prior Publication Data

US 2010/0194031 A1 Aug. 5, 2010

(30) Foreign Application Priority Data

Jan. 30, 2009 (JP) ..... 2009-020824

(51) Int. Cl.
*B65H 7/02* (2006.01)

(52) U.S. Cl.
USPC ..... 271/31; 271/97; 271/98

(58) Field of Classification Search ..... 271/97, 271/98, 31
See application file for complete search history.

(56) References Cited

U.S. PATENT DOCUMENTS

| | | | | |
|---|---|---|---|---|
| 5,090,676 | A * | 2/1992 | Matsuno et al. | 271/12 |
| 5,135,213 | A * | 8/1992 | Malachowski et al. | 271/104 |
| 5,645,274 | A | 7/1997 | Ubayashi et al. | |
| 6,186,492 | B1 * | 2/2001 | Dechau et al. | 271/30.1 |
| 6,543,759 | B2 * | 4/2003 | Yamaguchi et al. | 271/98 |
| 6,671,491 | B1 | 12/2003 | Yamanaka et al. | |
| 7,267,337 | B2 * | 9/2007 | Moore et al. | 271/148 |
| 7,364,150 | B2 * | 4/2008 | Nakane | 271/97 |
| 7,458,570 | B2 * | 12/2008 | Ueda et al. | 271/97 |
| 7,540,489 | B2 * | 6/2009 | Kushida | 271/98 |
| 7,588,244 | B2 * | 9/2009 | Kawamoto et al. | 271/31 |
| 7,591,459 | B2 | 9/2009 | Matsumoto et al. | |
| 7,635,125 | B2 | 12/2009 | Ikeda | |
| 7,850,162 | B2 * | 12/2010 | Imai et al. | 271/31 |
| 8,262,080 | B2 * | 9/2012 | Matsumoto et al. | 271/98 |
| 2005/0206068 | A1 * | 9/2005 | Sasaki et al. | 271/98 |
| 2006/0012107 | A1 | 1/2006 | Ueda et al. | |
| 2007/0228640 | A1 | 10/2007 | Ikeda | 271/98 |
| 2007/0284805 | A1 * | 12/2007 | Ikeda | 271/11 |
| 2008/0143037 | A1 | 6/2008 | Imai et al. | |
| 2008/0251999 | A1 | 10/2008 | Yamanaka et al. | |
| 2008/0315498 | A1 | 12/2008 | Ikeda | |

FOREIGN PATENT DOCUMENTS

| | | | |
|---|---|---|---|
| CN | 101051198 | A | 10/2007 |
| JP | 11-322101 | A | 11/1999 |

OTHER PUBLICATIONS

European Search Report and European Search Opinion in counterpart European Patent Application No. 10151591.4, mailed Jul. 16, 2012.

* cited by examiner

*Primary Examiner* — Stefanos Karmis
*Assistant Examiner* — Ernesto Suarez
(74) *Attorney, Agent, or Firm* — Fitzpatrick, Cella, Harper & Scinto

(57) ABSTRACT

Even if a sheet surface detection mechanism outputs a signal indicating that an uppermost sheet among blown-up sheets is within a conveyance range, if a trailing edge sheet surface sensor outputs a signal indicating that the uppermost sheet among the blown-up sheets is lower than the conveyance range when the conveyed uppermost sheet passes by the trailing edge sheet surface sensor, a lifting and lowering portion is controlled to lift the tray so that the uppermost sheet is positioned within the conveyance range.

10 Claims, 17 Drawing Sheets

IMAGE FORMING APPARATUS

BACKGROUND OF THE INVENTION

1. Field of the Invention

The present invention relates to an image forming apparatus for forming an image on a sheet, and more particularly, to an image forming apparatus that blows air onto sheets so that the sheets are separated from each other and fed through the image forming apparatus.

2. Description of the Related Art

Conventionally, an image forming apparatus such as a printer and a copying machine includes a sheet feeding device for feeding a sheet one by one from a sheet-containing portion in which a plurality of sheets are contained. As an example of the sheet feeding device, as described in U.S. Pat. No. 5,645,274, there is a sheet feeding device using air to separate and lift sheets, in which a plurality of sheets are blown upwards by blowing air to an end portion of a sheet stack supported by a lifting and lowering tray and only one sheet at a time is suctioned onto a suction conveyer belt provided above.

FIG. 13 illustrates an example of the conventional blown air sheet feeding device. As illustrated in FIG. 13, a lifting and lowering tray 12 on which a plurality of sheets S are stacked is provided in a sheet container 11. When the sheets S are set on the tray 12, positions of the sheets S are retained at an end (hereinafter referred to as a leading edge) on a downstream side in a sheet feeding direction by a leading edge regulation plate 17, and the positions of the sheets S are retained at an end (hereinafter referred to as a trailing edge) on an upstream side in the sheet feeding direction by a trailing edge regulation plate 13. Further, the positions of the sheets S are also retained at both side edges in a direction (hereinafter referred to as a width direction) orthogonal to the sheet feeding direction by side regulation plates 14.

A suction conveyer portion 20, which includes a suction conveyer belt 21 for drawing up and conveying the sheet S, and an air blowing portion 30 are provided above the sheet container 11. The air blowing portion 30 blows the air to the end part of the sheets S stack on the tray to blow the a plurality of sheets S upwards, and the air blowing portion 30 separates each of the sheets S.

The air blowing portion 30 sucks air from the direction indicated by the arrows C and blows a part of this air in the direction indicated by the arrows D, and hence a few upper sheets among the sheets stack on the tray 12 are blown upwards. In addition, the air blowing portion 30 blows another part of the air in the direction indicated by the arrows E, and hence an uppermost sheet among the sheets lifted by blown air is separated from the others. The uppermost sheet can thus be drawn up by the suction conveyer belt 21.

Frequently the sheet feeding device is adopted for a high-productive machine which is capable of feeding (seventy) A4-size or LTR-size sheets or more per minute. The tray 12 includes a mechanism in which a drive unit (not shown) lifts and lowers the tray 12 in a vertical direction while keeping the tray 12 substantially horizontal. FIG. 13 also shows the conveying portion 20 that is a circular conveyer belt 21 rotated by rollers 41, to be described in more detail later.

FIG. 14 is a plan view illustrating details of the sheet container 11. The trailing edge regulation plate 13 for regulating the trailing edge of a sheet is disposed while being movable in parallel with the sheet feeding direction indicated by the arrow H. The side regulation plates 14 and 16 for regulating the side edges of a sheet are movable in the sheet width direction indicated by the arrows V.

Thus, the trailing edge regulation plate 13 and the side regulation plates 14 and 16 are movable, with the result that a minimum-size sheet SS to a maximum-size sheet LS can be stacked and supported on the tray 12. In order not to obstruct the movement of the side regulation plates 14 and 16, the trailing edge regulation plate 13 is disposed so as to be movable only in a central part in the width direction of the tray 12.

Here, the trailing edge regulation plate 13 is provided with a trailing edge separating portion 18 capable of moving in the vertical direction for regulating a position of a trailing edge portion that is an end on the upstream side in the sheet feeding direction of the uppermost sheet Sa. The trailing edge separating portion 18 has protrusions 18D protruding from a regulation portion surface 13C of the trailing edge regulation plate 13 illustrated in FIG. 13, and for pressing the trailing edge portion of the uppermost sheet Sa from above. A separation aid sheet 18E made of a material having a high friction coefficient is glued to the lower surface side of the protrusion 18D that contacts with the sheet, for applying resistance to the upper surface of the stacked sheets.

When the uppermost sheet Sa is fed by a length L2 corresponding to the protruding length of the protrusion 18D as illustrated in FIG. 13, the trailing edge separating portion 18 is lowered so as to abut the sheet Sb immediately below the uppermost sheet Sa. In this case, because of a frictional force generated by a weight of the trailing edge separating portion 18, it is possible to prevent the second-from-the-top sheet Sb from being conveyed while the uppermost sheet Sa is being conveyed, and hence occurrence of feeding more than one sheet can be suppressed. In addition, if there is no sheet positioned on the tray, the protrusion 18D abuts a surface of the tray 12.

In FIG. 13, supporting portions 18A are provided on the trailing edge separating portion 18, so as to engage with an engaging portion 13E that is provided on the trailing edge regulation plate 13. Then, the supporting portions 18A are provided with a ball bearing or a roller having a low surface friction resistance, and hence the trailing edge separating portion 18 can be moved smoothly in the directions indicated by the arrow G in FIG. 13.

Concerning the conventional sheet feeding device of such an air feeding type, U.S. Patent Publication No. 2007/228640 describes a sheet feeding device provided with a sheet surface detection mechanism for controlling a position of the uppermost surface of sheets contained in the sheet container 11.

FIGS. 15A and 15B are diagrams illustrating a structure of the conventional sheet surface detection mechanism. As illustrated in FIGS. 15A and 15B, the sheet surface detection mechanism 49 includes a sheet surface detection sensor flag 52, a first sheet surface sensor 54 and a second sheet surface sensor 55 that are turned on and off by rotation of the sheet surface detection sensor flag 52, and a sensor flag mechanism 50. The first sheet surface sensor 54 and the second sheet surface sensor 55 are photosensors and are connected to a control device (not shown).

Here, the sheet surface detection sensor flag 52 is supported by a support shaft 53 so that the sheet surface detection sensor flag 52 is capable of swinging.

Further, the sheet surface detection sensor flag 52 is provided with a first detection portion 52B for shielding a light receiving portion of the first sheet surface sensor 54, a second detection portion 52C for shielding a light receiving portion of the second sheet surface sensor 55, and a supporting portion 52D for supporting, in a rotatable manner, the sheet surface detection member 61 to be described later. The mechanism of the sheet surface detection sensor flag 52 is shown in larger detail in FIG. 15B.

The sensor flag mechanism 50 includes a supporting member 60 having an end 60*a* that is retained in a rotatable manner inside a suction duct 22, and a sheet surface detection member 61 that is supported at a first end by a rotation end 60*b* of the supporting member 60 and at a second end by a supporting portion 52D of the sheet surface detection sensor flag 52.

The sheet surface detection member 61 is disposed below a suctioning and conveying region of the suction conveyer portion 20, in parallel to the sheets S stacked on the tray 12, and in a movable manner in the vertical direction. A distance between the upper surface of the uppermost sheet Sa that is lifted while lifting the sheet surface detection member 61 and a belt surface of a suction conveyer belt 21 is S1. In addition, the supporting member that is supported in a rotatable manner inside the suction duct 22 protrudes from retraction holes 51H1, 51H2 formed in a gap between a plurality of suction conveyer belts 21 in the sheet width direction to the lower side of the suctioning and conveying region of the suction conveyer belt 21 as illustrated in FIGS. 16A and 16B. FIGS. 16A and 16B are views from underneath the suction conveyer belt 21.

The supporting member 60, the sheet surface detection sensor flag 52, and the sheet surface detection member 61 are disposed in a line as shown in FIG. 16B. Thus, even if the sheet abuts any position in the longitudinal direction of the sheet surface detection member 61, the sheet surface detection member 61 is capable of moving vertically while keeping its parallel posture (horizontal posture) and swinging the sheet surface detection sensor flag 52.

Next, a sheet surface control operation based on detection by the sheet surface detection mechanism 49 having the above-mentioned structure will be described.

When the sheets contained in the sheet container are lifted by the lifting of the tray 12, the upper surface of the uppermost sheet Sa abuts the sheet surface detection member 61. Then, when the tray 12 is further lifted, the sheet surface detection member 61 is lifted along with the uppermost sheet Sa. When the sheet surface detection member 61 is lifted, the sheet surface detection sensor flag 52 swings the supporting portion 52D upward about the support shaft 53 as its centre.

After a specific amount of time (dependent on the speed of lifting of the tray 12 and the number of sheets in the tray), as illustrated in FIG. 17A, a distance between the upper surface of the uppermost sheet Sa that is lifted while lifting the sheet surface detection member 61 and a belt surface of the suction conveyer belt 21 becomes S1. In this state, the first detection portion 52B of the sheet surface detection sensor flag 52 shields the first sheet surface sensor 54, while the second detection portion 52C shields the second sheet surface sensor 55, and hence ON signals are output. At this time, the control device stops the tray 12 based on the ON signals from the first sheet surface sensor 54 and the second sheet surface sensor 55.

Next, when receiving a feed start signal, the control device starts the air blow and controls the air input so that the upper portion SA of the sheet stack is blown upwards as illustrated in FIG. 17B and the tray 12 is lifted or lowered, thereby the uppermost sheet Sa is blown upwards in a predetermined region.

Here, when the second detection portion 52C of the sheet surface detection sensor flag 52 shields the second sheet surface sensor 55, the ON signal is output. Then, the position at which the second sheet surface sensor 55 is turned on is set as a lower limit of the air input region. If the ON signal of the second sheet surface sensor 55 is not obtained while the first sheet surface sensor 54 is on, it is determined that the position is "too low", and the tray 12 is lifted until the ON signal is obtained.

In addition, as illustrated in FIG. 18, when a distance between the belt surface of the conveyer belt 21 and the upper surface of the uppermost sheet Sa becomes smaller than SH, the shielding by the first detection portion 52B is cancelled, and hence the first sheet surface sensor 54 does not generate the ON signal (but rather generates an OFF signal). This position is thus set as an upper limit of the air input region. If the ON signal of the first sheet surface sensor 54 is not obtained while the second sheet surface sensor 55 is on, it is determined that the position is "too high", and the tray 12 is lowered until the ON signal is obtained.

Such series of operations is shown in the following table.

TABLE 1

| First sheet surface sensor 54 | Second sheet surface sensor 55 | Tray action |
|---|---|---|
| ON | OFF | Lift |
| ON | ON | Stop |
| OFF | ON | Lower |

Thus, by lifting and lowering the tray 12 based on the signals from the first and the second sheet surface sensors 54 and 55, a position of the tray 12 can be controlled to be the position where only the uppermost sheet Sa can be separated from others and conveyed. Thus, when the suction conveyer belt 21 draws up the sheet, the sheets S can be separated and fed to the image forming portion one by one. Thus, it is possible to achieve stable feeding of sheets.

There is a case where an upward curl occurs at the end portion of the sheets stacked on the tray 12 on the downstream side in the sheet feeding direction. In this case too, as illustrated in FIG. 15A described above, the sheet surface detection member 61 abuts the sheet with the curl at the end portion on the downstream side in the sheet feeding direction. Then, the sheet surface detection member 61 that abuts the sheet changes its position in parallel vertically so as to rotate the sheet surface detection sensor flag 52. Therefore, the first sheet surface sensor 54 and the second sheet surface sensor 55 are turned on and off appropriately, and hence the above-mentioned sheet surface control is performed.

In other words, the lifting and lowering of the tray 12 is controlled so that an appropriate level (appropriate distance between the suction conveyer belt 21 and the upper sheet surface) S1 is obtained at the position where the sheet surface detection member 61 abuts the sheet. Further, the upper surface of the sheet is controlled to be the appropriate level in this way, and hence a gap is generated between the sheet end portion and the suction conveyer belt 21, and hence the separation air is allowed to enter smoothly as illustrated by the arrows in FIG. 15A. As a result, the separation air securely separates the sheet from other sheets, and hence the feeding more than one sheet or jamming of a sheet can be prevented.

It is possible to dispose the sheet surface detection sensor flag 52 and the first and the second sheet surface sensors 54 and 55 outside the suctioning and conveying region of the suction conveyer belt 21 and on the upstream side in the sheet feeding direction. In this case too, the detection can be performed on the leading edge side of the sheet S, and hence the feeding of the sheet S can securely be performed. In addition, the first and the second sheet surface sensors 54 and 55 are not disposed inside the suction duct 51 in this way, and hence it is possible to reduce a height of the suction conveyer portion 20 so that the image forming apparatus can be downsized in the height direction.

The suction duct 51 is provided with the holes 51H1 and 51H2 for housing the sheet surface detection member 61 as illustrated in FIGS. 16A and 16B described above, so as not to cause resistance against conveying the sheet when the suction conveyer belt 21 draws up the uppermost sheet. The hole 51H1 is formed in the suction duct 51 in parallel to the suctioning surface (to which the sheet is drawn up) among the plurality of suction conveyer belts 21, and the hole 51H2 is formed along a vertical wall of the suction duct 51. Further, when the suction conveyer belt 21 draws up the uppermost sheet, the drawn up sheet retracts the sheet surface detection member 61 upward to be housed in the holes 51H1 and 51H2. Thus, the sheet surface detection member 61 does not protrude downward from the suctioning surface of the suction conveyer belt 21.

The hole 51H1 is formed in parallel with the suction conveyer belt 21, and hence the hole 51H1 is covered with the uppermost sheet drawn up by the suction conveyer belt 21. Thus, air is not prone to serious leaks from the hole 51H1. In addition, the hole portion 51H2 is formed in the direction orthogonal to the suctioning surface of the suction conveyer belt 21, but when the sheet surface detection member 61 is housed in the suction duct 51, the hole portion 51H2 is blocked with the sheet surface detection member 61 itself, and hence air is not prone to serious leaks through this hole 51H2 either. As a result, though the holes 51H1 and 51H2 are formed in the suction duct 51, a suctioning force is not lowered. Thus, a feeding failure of the sheet does not occur.

In the above-mentioned conventional sheet treating apparatus and the image forming apparatus provided with the same, as illustrated in FIG. 19, the sheet surface detection member 61 is housed inside the suction duct 51 in the period while the uppermost sheet Sa is conveyed. Further, in the period while the sheet surface detection member 61 is housed inside the suction duct, a level of the sheet surface of the second sheet Sb cannot be checked.

Here, the sheet surface of the second sheet Sb can only be checked when the trailing edge of the uppermost sheet Sa conveyed by the suction conveyer belt 21 passes by the sheet surface detection member 61 and the sheet surface detection member 61 drops using its weight under gravity so as to contact with the surface of the sheet Sb.

For instance, when a sheet Sa of A4 size (having the conveying-direction length of 210 mm) is conveyed by the suction conveyer belt 21 and passes by the end portion on the downstream side in the conveying direction of the sheet surface detection member 61 (L2=10 mm in FIG. 13) and drops so as to contact with the sheet Sb, necessary time period is as follows.

It is supposed that a sheet conveying speed of the suction conveyer belt 21 is approximately 1,000 mm/sec. Then, the time period when the sheet surface detection member 61 drops and contacts with the sheet Sb is (210-10)/1,000, i.e., approximately 200 milliseconds. In addition, if the sheet Sb is blown upwards below the appropriate position by 1 mm, it takes approximately 20 milliseconds for the sheet surface detection member 61 dropping by its weight to contact with the upper surface of the sheet Sb.

In addition, if a blown-upward level of the sheet Sb is not an appropriate level, it takes time to lift the tray so that the sheet surface is lifted to the appropriate level. For instance, supposing that the lifting speed of the tray is approximately 0.1 mm/sec, it takes approximately 100 milliseconds to lift the tray to the appropriate position.

In other words, if the blown-up level of the sheet is not appropriate, time period necessary for checking the sheet surface of the sheet Sb includes time until the housed state of the sheet surface detection member 61 is cancelled, time period for the sheet surface detection member 61 to become able to detect, and time period until the sheet Sb is blown upwards to be the appropriate level. In other words, to check the sheet surface of the sheet Sb whose blown-upward level is not appropriate, it takes approximately 320 milliseconds (i.e., approximately 200 milliseconds+approximately 20 milliseconds+approximately 100 milliseconds).

Here, it is supposed that a sheet feeding device is capable of usually feeding 120 sheets of A4 size per minute. Then, time per sheet is approximately 500 milliseconds. However, if it takes approximately 320 milliseconds to check the sheet surface of the sheet Sb, productivity is lowered from approximately 120 sheets per minute (approximately 500 milliseconds per sheet) to approximately 71 sheets per minute (approximately 820 milliseconds per sheet). Further, the larger the length of the contained sheet, the longer the time period of housing the sheet surface detection member 61. Therefore, if sheets of A3 size or larger are used, the throughput of sheets is further lowered.

SUMMARY OF THE INVENTION

Therefore, the present invention has been made in view of the above-mentioned current situation, and it is desirable to provide an image forming apparatus capable of feeding sheets through the apparatus with good throughput of the sheets.

According to the present invention, there is provided a sheet-feeding device configured to feed sheets, the sheet feeding device comprising; a tray configured to support a stack of sheets, a lifting and lowering portion configured to lift and lower the tray, a control portion configured to control the lifting and lowering portion, an air blowing portion configured to blow air at an end of the stack of sheets to cause a top sheet of the stack of sheets to be separated and lifted from the stack of sheets when in use, a suction conveyer configured to draw up and convey the top sheet separated and lifted by the air blown by the air blowing portion, a first detection portion configured to detect the upper surface of the top sheet, wherein the control portion is configured to control the lifting and lowering portion based on an output by the first detection portion so that in use, the top sheet of the stack of sheets is positioned in a conveyance range in which the suction conveyer can convey the current top sheet, and a second detection portion configured to detect the upper surface of a trailing end portion of the stack of sheets, wherein the control portion is further configured to control the lifting and lowering portion in response to an output of the second detection portion such that when the second detection portion detects that the upper surface of the stack of sheets is lower than a predetermined level (REFERENCE LEVEL), the lifting and lowering portion is adapted to lift the tray until the upper surface of the stack of sheets is above the predetermined level. As a second aspect of the invention, there is provided an image forming apparatus comprising the sheet-feeding device.

Further features of the present invention become apparent from the following description of exemplary embodiments with reference to the attached drawings.

DESCRIPTION OF THE EMBODIMENTS

Detailed description of an exemplary embodiment of the invention is described below with reference to the drawings.

Figure 1:
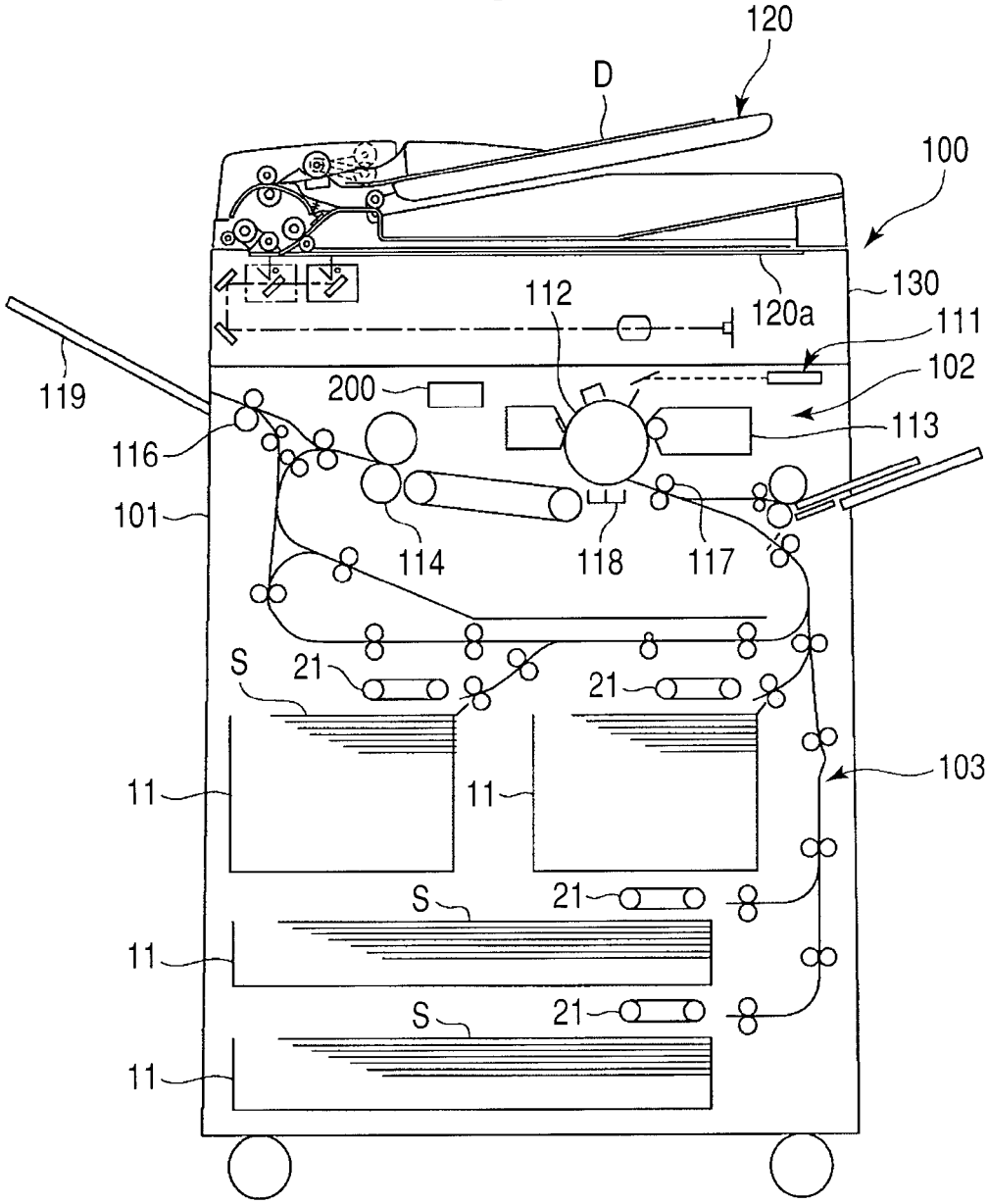
FIG. 1 is a diagram illustrating a schematic structure of a printer as an example of an image forming apparatus according to an embodiment of the present invention.

FIG. 1 is a diagram illustrating a schematic structure of a printer as an image forming apparatus provided with a sheet feeding device according to an embodiment of the invention.

In FIG. 1, an image scanning portion 130 is provided in an upper portion of a printer main body 101 of the printer 100, for scanning an original D, which is placed on a platen glass 120*a* as an original-placing platen by an automatic original feeder 120. Further, an image forming portion 102 and a sheet feeding device 103 for feeding a sheet S to the image forming portion 102 are provided below the image scanning portion 130.

Here, the image forming portion 102 includes a photosensitive drum 112, a development device 113, and a laser scanner unit 111. Further, the sheet feeding device 103 includes a plurality of sheet containers 11 and suction conveyer belts 21 serving as feeding belts. The sheets S such as OHT (overhead projector transparencies) are contained in the sheet containers 11, and the sheet containers 11 are detachably attached to the printer main body 101. The feeding belt is an example of a sheet feeding unit configured to feed the sheets S contained in the sheet container 11 to the image forming portion 102.

The image forming operation of the printer 100 having the above-mentioned structure will be described below.

The image scanning portion 130 scans an image when a control device (illustrated in FIG. 3 to be described later) included in the device body 101 outputs an image scanning signal to the image scanning portion 130. Then, a laser scanner unit 111 emits a laser beam according to an electric signal of the scanned image to irradiate the photosensitive drum 112. Here, the photosensitive drum 112 is previously charged, and an electrostatic latent image is formed by the laser beam irradiation. Then, the development device 113 develops the electrostatic latent image to form a toner image on the photosensitive drum 112.

Elsewhere, the sheet S is fed from the sheet container 11 when the control device outputs a sheet feeding signal to the sheet feeding device 103. Then, a registration roller 117 conveys the fed sheet S to a transfer portion in synchronization with the toner image on the photosensitive drum 112. The transfer portion is formed by the photosensitive drum 112 and a transfer charger 118.

Next, the toner image is transferred to the sheet S conveyed to the transfer portion, and the sheet is conveyed to a fixing portion 114. Then, the fixing portion 114 heats and pressurises the sheet S to fix permanently the unfixed transfer image to the sheet S. A discharge roller 116 discharges the sheet to which the image is transferred from the printer main body 101 to the discharge tray 119. The timing of the image forming apparatus is controlled by a control device 200.

Figure 2:
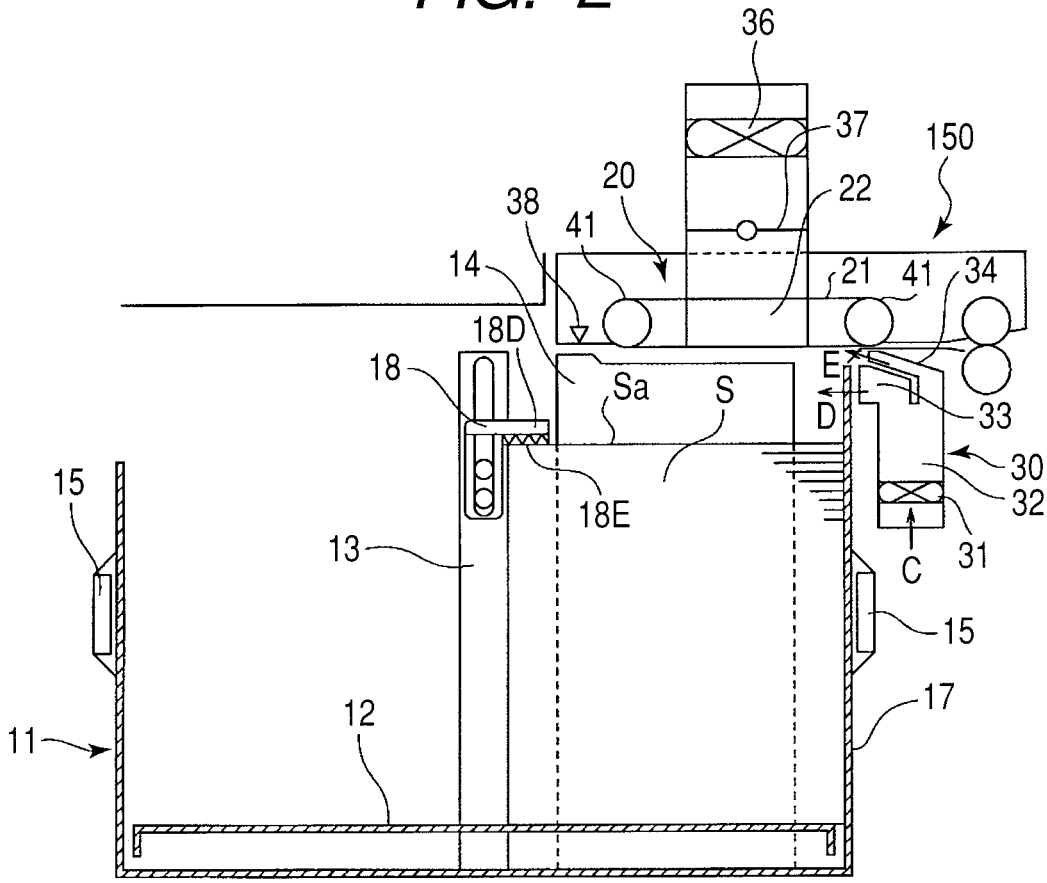
FIG. 2 is a diagram illustrating a structure of a sheet feeding device provided in the image forming apparatus illustrated in FIG. 1.
Figure 13:
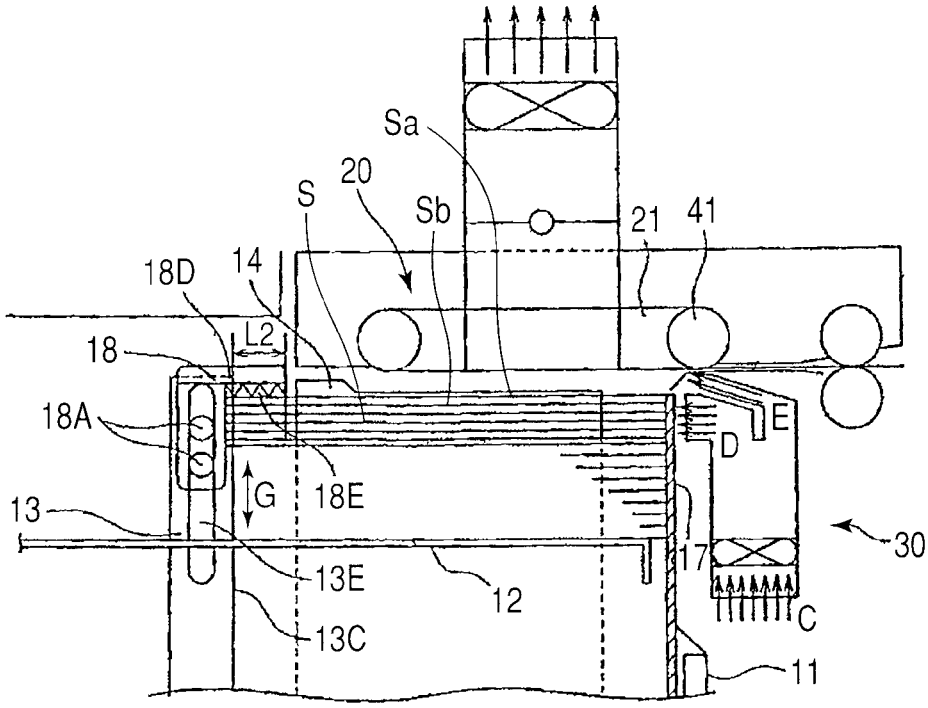
FIG. 13 is a diagram illustrating a structure of a sheet feeding device provided in a conventional image forming apparatus.
Figure 14:
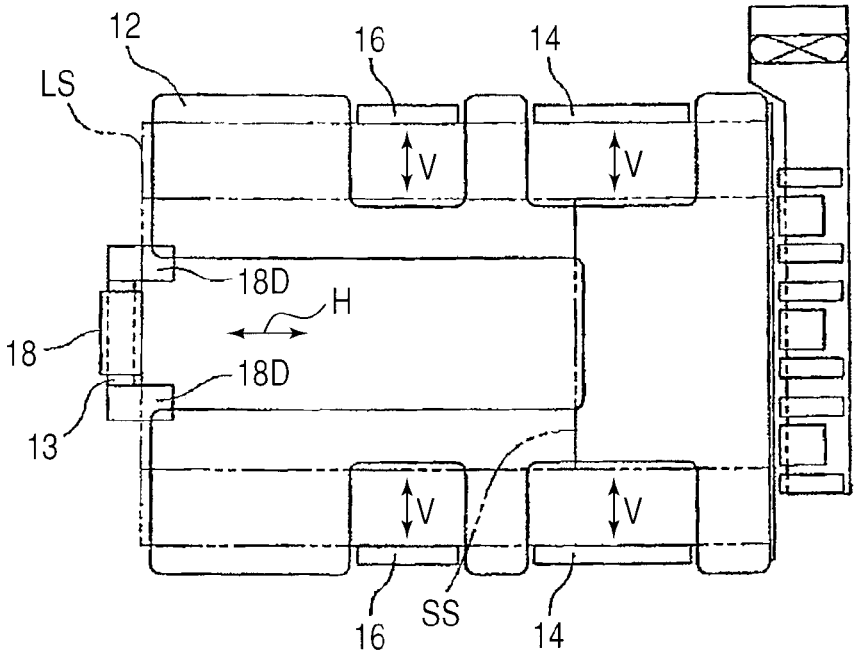
FIG. 14 is a plan view illustrating detail of a sheet container of the sheet feeding device illustrated in FIG. 13.
Figure 15A:
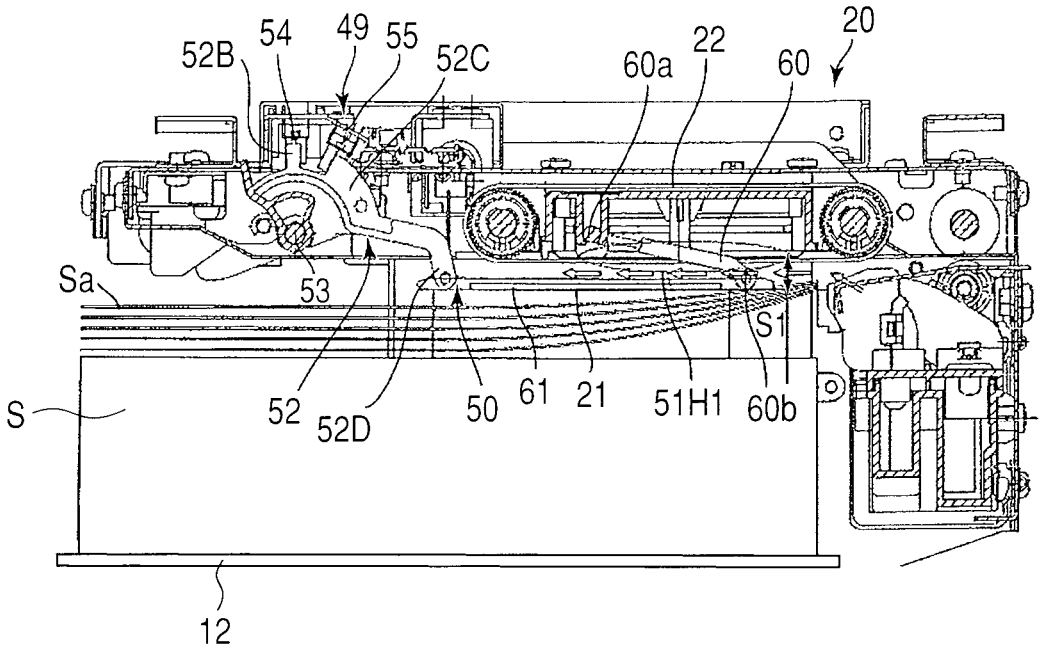
FIGS. 15A and 15B are a first pair of diagrams illustrating a structure of a sheet surface detection mechanism of the sheet feeding device illustrated in FIG. 13.
Figure 15B:
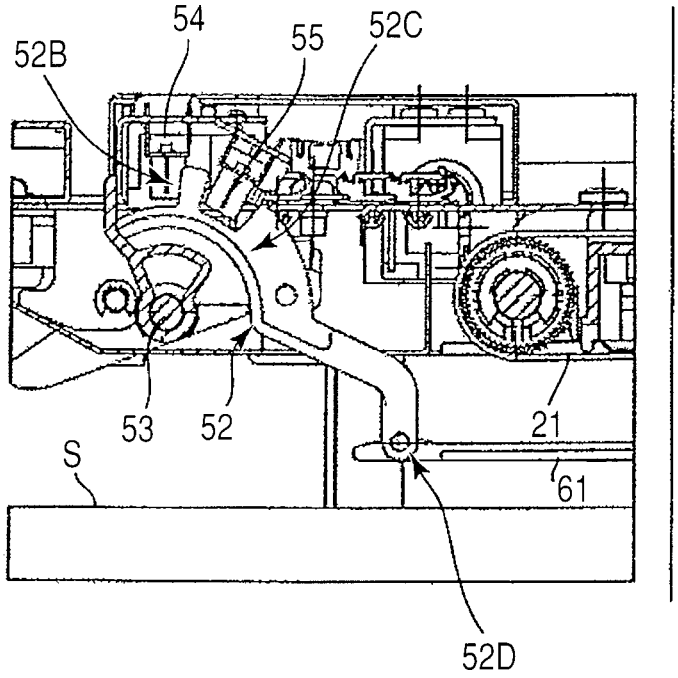
Figure 16A:
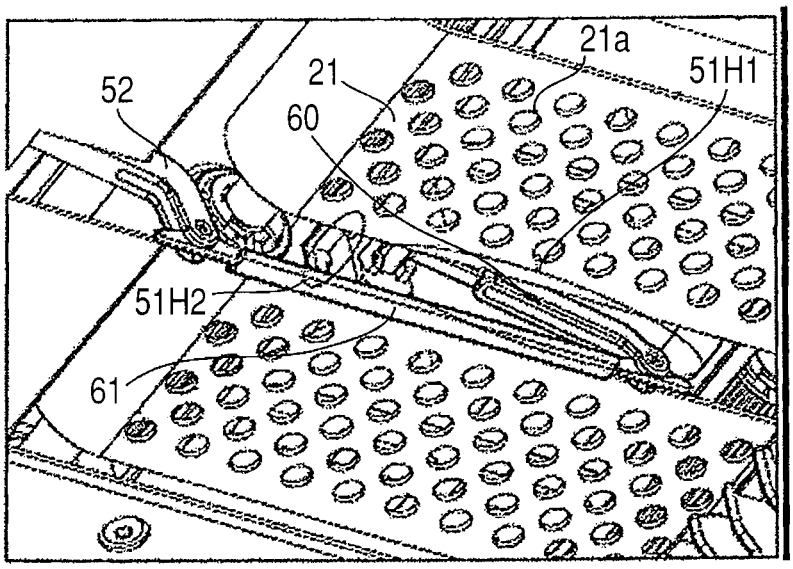
FIGS. 16A and 16B are a second pair of diagrams illustrating a structure of the sheet surface detection mechanism of the sheet feeding device illustrated in FIG. 13.
Figure 16B:
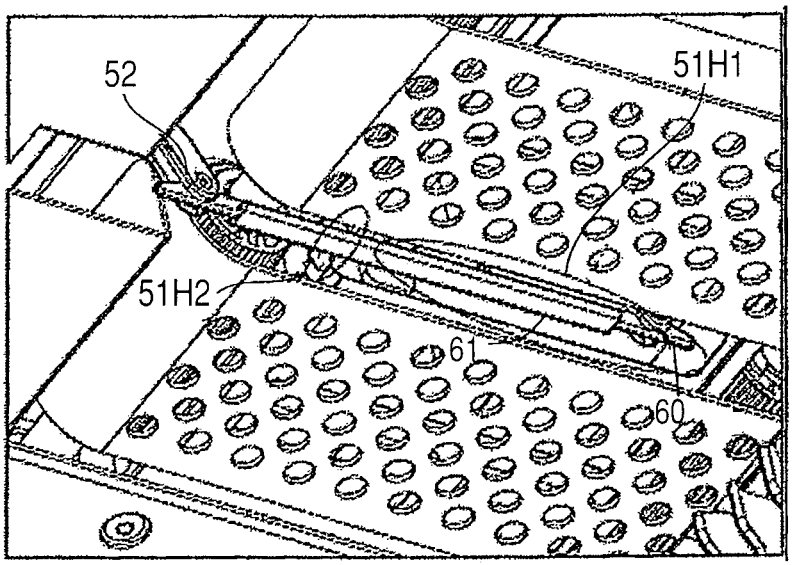
Figure 17A:
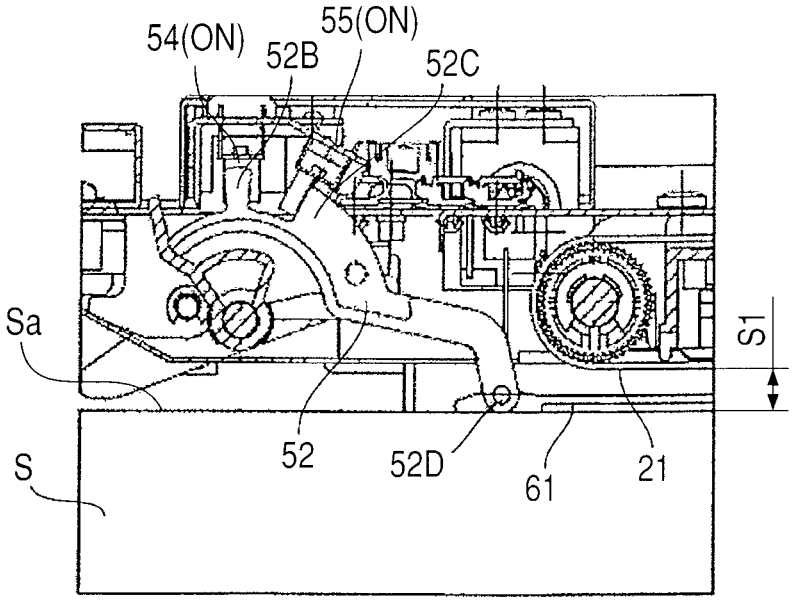
FIGS. 17A and 17B are first diagrams illustrating sheet surface control operation of the sheet feeding device illustrated in FIG. 13.
Figure 17B:
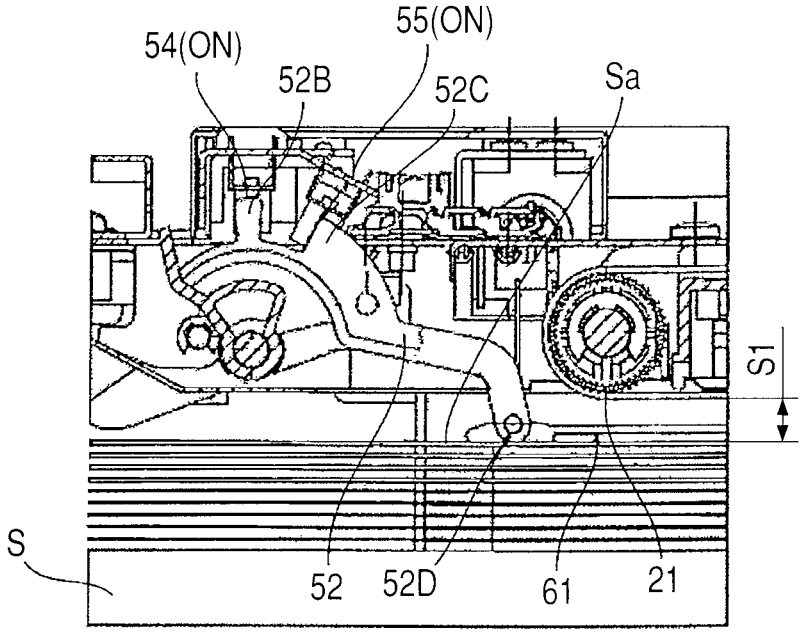
Figure 18:
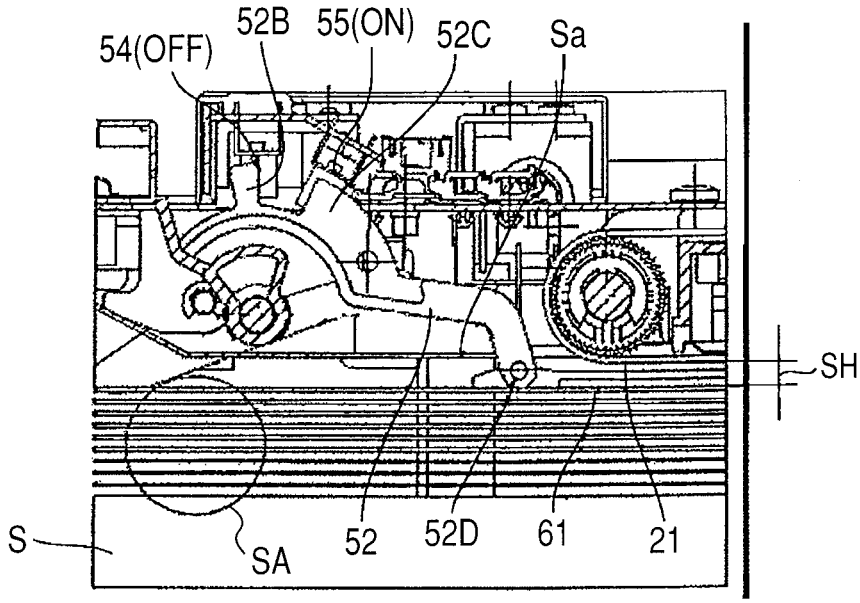
FIG. 18 is a second diagram illustrating the sheet surface control operation of the sheet feeding device illustrated in FIG. 13.
Figure 19:
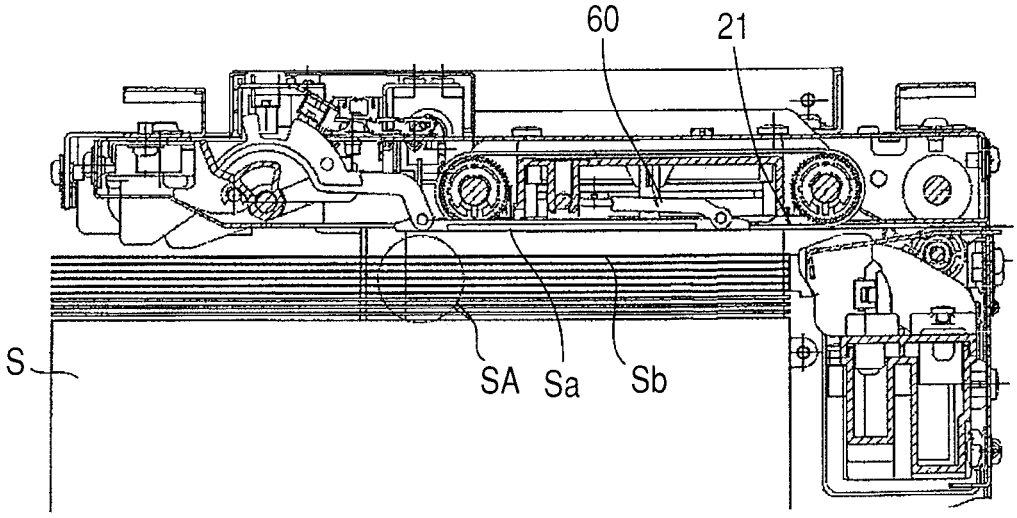
FIG. 19 is a third diagram illustrating the sheet surface control operation of the sheet feeding device illustrated in FIG. 13.

FIG. 2 illustrates a structure of the sheet feeding device 103. In FIG. 2, reference numerals the same as those in the above-mentioned FIG. 13 refer to the same or corresponding parts.

The sheet container 11 includes a tray 12 that is liftable and lowerable, a trailing edge regulation plate 13, a leading edge regulation plate 17, and side edge regulation plates 14 which regulate a position in the width direction orthogonal to a sheet feeding direction of the sheets S. The position of the trailing edge regulation plate 13 and the positions of the side edge regulation plates 14 can be changed according to the size of the contained sheet. In addition, the trailing edge regulation plate 13 abuts trailing edges of the sheets on the upstream side in the sheet conveying direction, and a trailing edge separating portion 18 is provided on the trailing edge regulation plate 13. The trailing edge separating portion 18 regulates a position of the trailing edge portion of the uppermost sheet Sa, the trailing edge portion being on the upstream side in the sheet feeding direction. The trailing edge separating portion 18 is movable in the vertical direction.

The sheet container 11 can be pulled out from a printer main body 101 along slide rails 15. When the sheet container 11 is pulled out from the printer main body, the tray 12 is lowered to a predetermined position so that sheets can be added or exchanged. The tray 12 is lifted and lowered by a stepping motor or a DC servo motor, and it is possible to lower the tray 12 by repeating a stepping operation of alternating between moving for a predetermined period and staying in a vertical position for a predetermined period.

In addition, a sheet feeding mechanism (hereinafter referred to as an air sheet feeding mechanism 150) of the air-controlled sheet feeding system configured to separate and feed the sheets one by one is disposed above the sheet container 11. The air sheet feeding mechanism 150 includes a suction conveyer portion 20 which conveys the sheet S stacked on the tray 12 while applying suction to the sheet S and an air blowing portion 30 which blows air onto the upper part of the sheet stack on the tray, thus separating the sheets S one by one.

Here, the suction conveyer portion 20 includes a suction conveyer belt 21 which is passed over the belt drive rollers 41 and which conveys the sheet S in the right direction in FIG. 2 while applying suction to the sheet S. The suction conveyer portion 20 also includes a suction fan 36 which generates a negative pressure in order to draw the sheet S up to the suction conveyer belt 21, and a suction duct 22 which is disposed within the suction conveyer belt 21 and which is used to suck the air through the suction holes (not shown) formed in the suction conveyer belt 21.

The suction conveyer portion 20 further includes a suction shutter 37 which is disposed between the suction fan 36 and the suction duct 22 to turn on and off the suction operation of the suction conveyer belt 21. In this embodiment, a plurality of suction conveyer belts 21 are disposed at predetermined intervals in the width direction, the width direction being orthogonal to the conveying direction of the paper and typically corresponding to the narrower dimension of rectangular sheets. The plurality of suction conveyer belts 21 may therefore be aligned side-by-side.

The air blowing portion 30 includes a loosening nozzle 33 (for "loosening" the sheets from each other) and a separation nozzle 34 (for separating the sheets from each other with a cushion of air). The loosening nozzle 33 and the separation nozzle 34 are configured to blow the air on an upper part of the contained sheets S. The air blowing portion 30 further includes a separation fan 31 and a separation duct 32, the latter of which supplies the air from the separation fan 31 to the loosening nozzle 33 and the separation nozzle 34.

Thus, a part of the air sucked (i.e. caused to flow) in the direction indicated by the arrow C by the separation fan 31 passes through the separation duct 32, and this portion of air is blown in the direction indicated by the arrow D through the loosening nozzle 33 to lift several sheets in the upper part of the sheets S stacked on the tray 12. The remaining air input into the air blowing portion 30 is blown out in the direction indicated by the arrow E through the separation nozzle 34, and this remaining air separates the sheets lifted by the loosening nozzle 33, one by one, and lets the suction conveyer belt 21 apply suction to a sheet to attract it to the suction conveyer belt.

Figure 3:
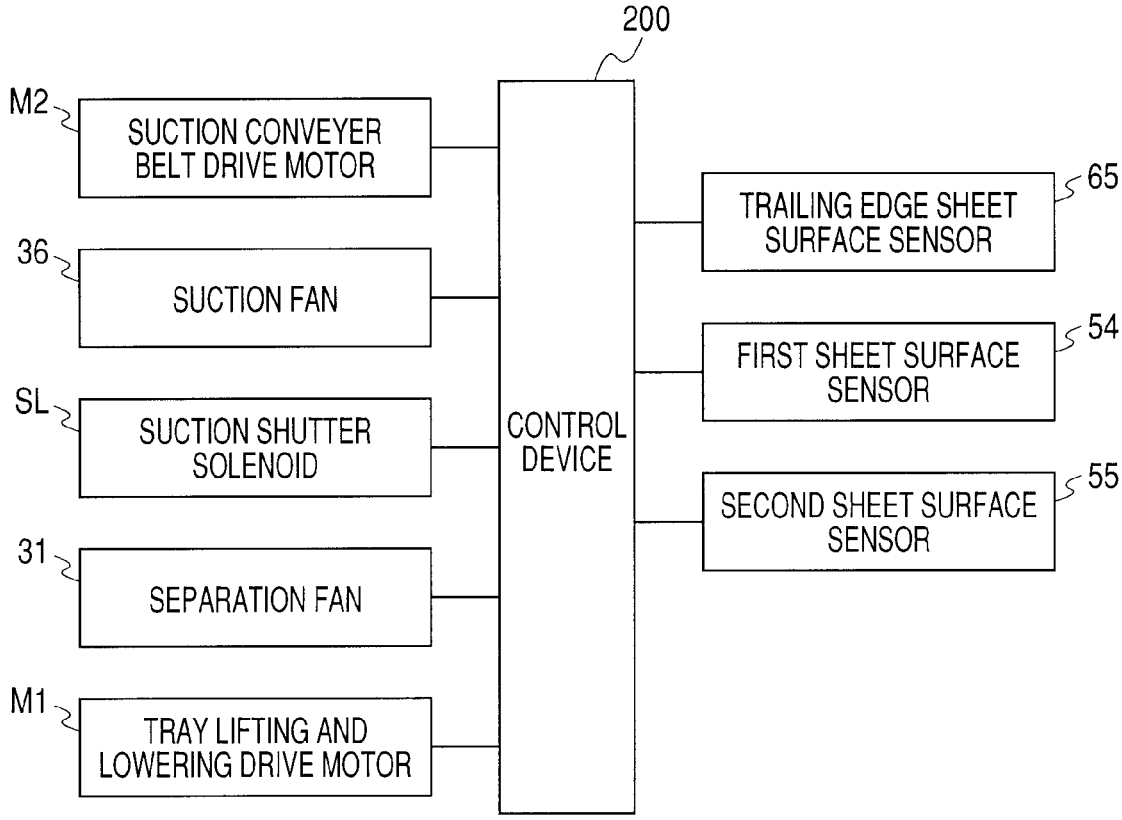
FIG. 3 is a control block diagram of the sheet feeding device provided in the image forming apparatus illustrated in FIG. 1.

FIG. 3 is a control block diagram of the sheet feeding device. The control device 200 is connected to a trailing edge sheet surface sensor configured to detect a trailing edge surface of a sheet, as well as to a first sheet surface sensor 54 and a second sheet surface sensor 55 that are provided in a sheet surface detection mechanism to be described later. In addition, the control device 200 is connected to a tray lifting and lowering drive motor M1 configured to lift and lower the tray 12, a suction conveyer belt drive motor M2 configured to drive a suction conveyer belt 21, and a shutter solenoid SL configured to rotate a suction shutter 37. In addition, the control device 200 is connected to a suction fan 36 configured to generate negative pressure for drawing a sheet up onto the suction conveyer belt 21, and a separation fan 31 configured to blow air to the sheet.

Next, the sheet feeding operation of the sheet feeding device 103 (the air sheet feeding mechanism 150) having the above-mentioned structure will be described.

Figure 4:
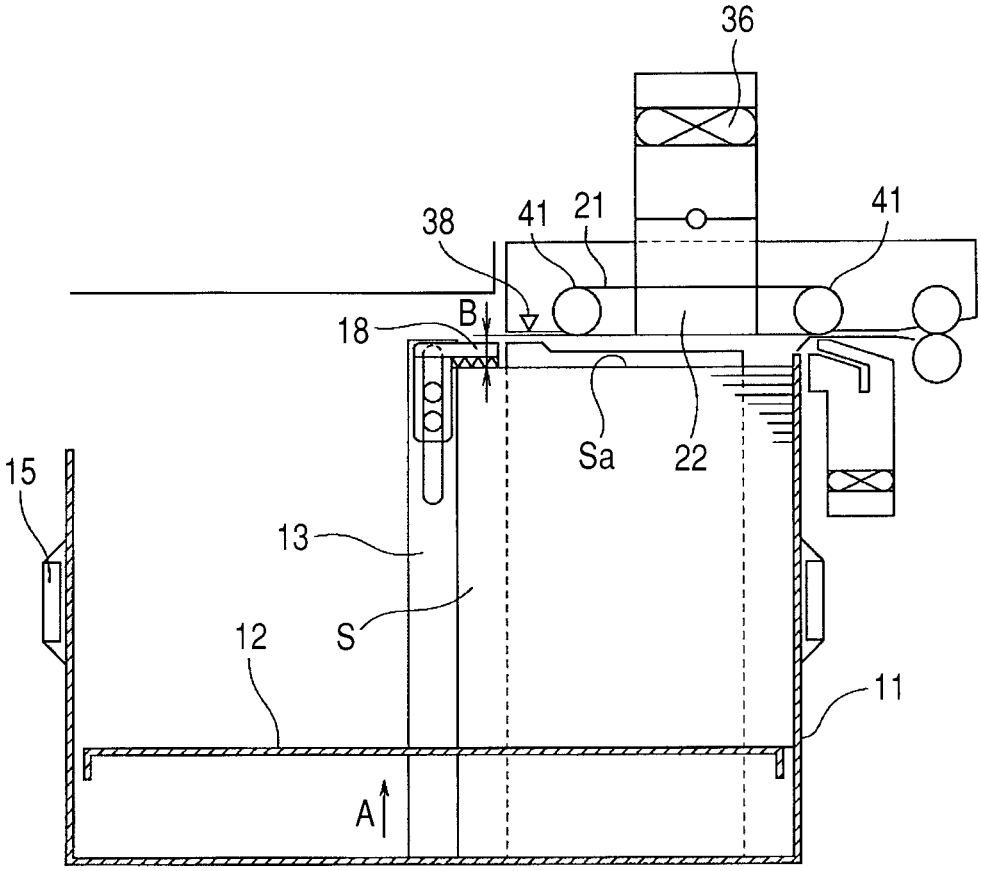
FIG. 4 is a first diagram illustrating a sheet feeding operation of the sheet feeding device provided in the image forming apparatus illustrated in FIG. 1.

First, a user pulls out the sheet container 11 to set sheets S on the tray 12. Thereafter, the user pushes in the sheet container 11 to a predetermined position as illustrated in FIG. 2. Then, a tray lifting and lowering drive motor M1 is driven by the control device 200 illustrated in FIG. 3. Thus, as illustrated in FIG. 4, the tray 12 is lifted in the direction indicated by the arrow A. When a distance between the suction conveyer belt 21 and the uppermost sheet Sa is reduced to a distance B, it has reached a sheet feed-ability position where the sheet can be fed and the control device 200 stops the tray 12 at that position. Then, the control device 140 is ready to detect a sheet-feeding signal for starting the sheet feed.

Figure 5A:
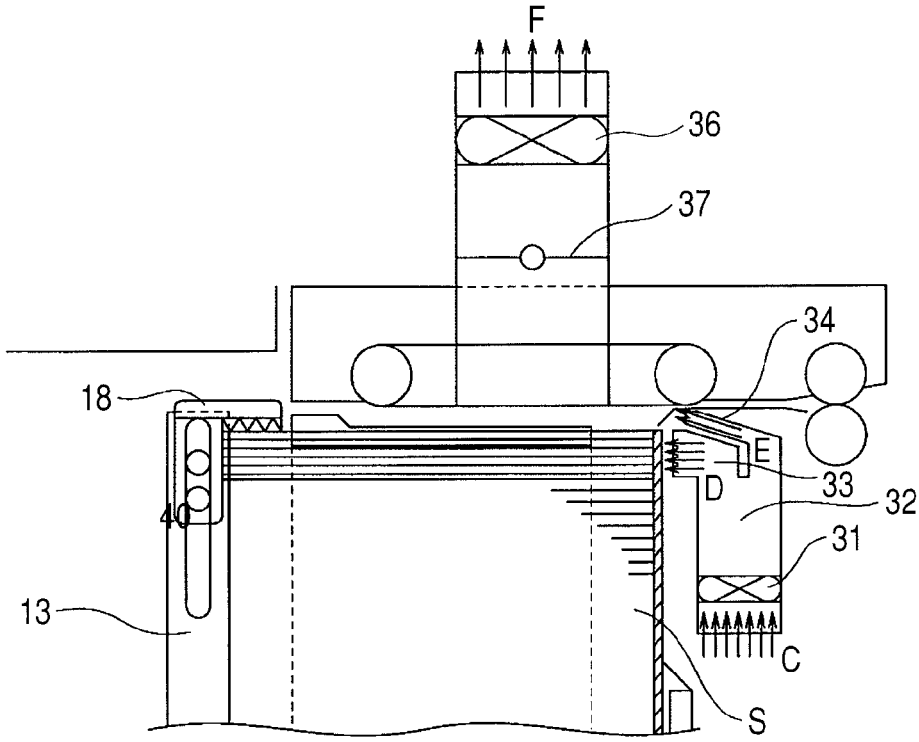
FIGS. 5A and 5B are second and third diagrams illustrating the sheet feeding operation of the sheet feeding device provided in the image forming apparatus illustrated in FIG. 1.

Next, when the control device 200 detects the sheet-feeding signal, the control device 200 activates the separation fan 31 to suck the air in the direction indicated by the arrow C as illustrated in FIG. 5A. The air passes through the separation duct 32, and the air is blown from the loosening nozzle 33 and the separation nozzle 34 in the directions indicated by the arrows D and E, respectively, to the sheet stack. Thereby, several sheets in the upper part of the sheet stack are lifted and separated by the blown air. The control device 200 also activates the suction fan 36 to output the air as exhaust air in the direction indicated by the arrow F in FIG. 5A. At this time, the suction shutter 37 is still closed such that air is not blown through the conveyer belts 21, but rather, a negative pressure is created in the space between the fan 36 and the shutter 37.

Figure 5B:
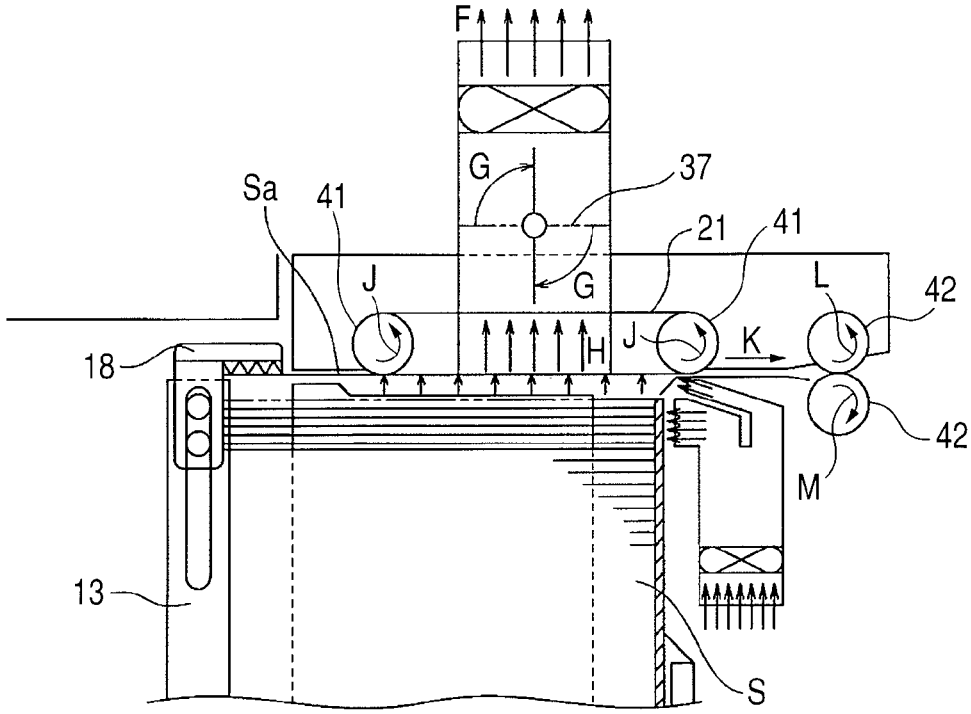

When a predetermined time has passed from the detection of the sheet feeding signal so that lifting of the upper sheet Sa is stabilized, the control device 200 drives the shutter solenoid SL so that the suction shutter 37 is rotated in the direction indicated by the arrow G as illustrated in FIG. 5B. The rotation of the suction shutter 37 causes a passage through the shutter to open. Thus, a suction force in the direction indicated by the arrow H is generated through suction holes provided in the suction conveyer belt 21. The combination of this suction force H and separation air E from the separation nozzle 34 enables only the uppermost sheet Sa to be drawn up onto the suction conveyer belt 21.

Then, a suction conveyer belt drive motor M2 illustrated in FIG. 3 is driven by the control device 200 and, as illustrated in FIG. 5B, the belt drive roller 41 is rotated in the direction indicated by the arrows J. As a result, the uppermost sheet Sa is conveyed in the direction indicated by the arrow K in the state in which the uppermost sheet Sa is drawn up onto the suction conveyer belt 21. Then, the uppermost sheet Sa is conveyed toward the image forming portion by a pair of draw rollers 42 rotated in the directions indicated by the arrows L and M.

Figure 6A:
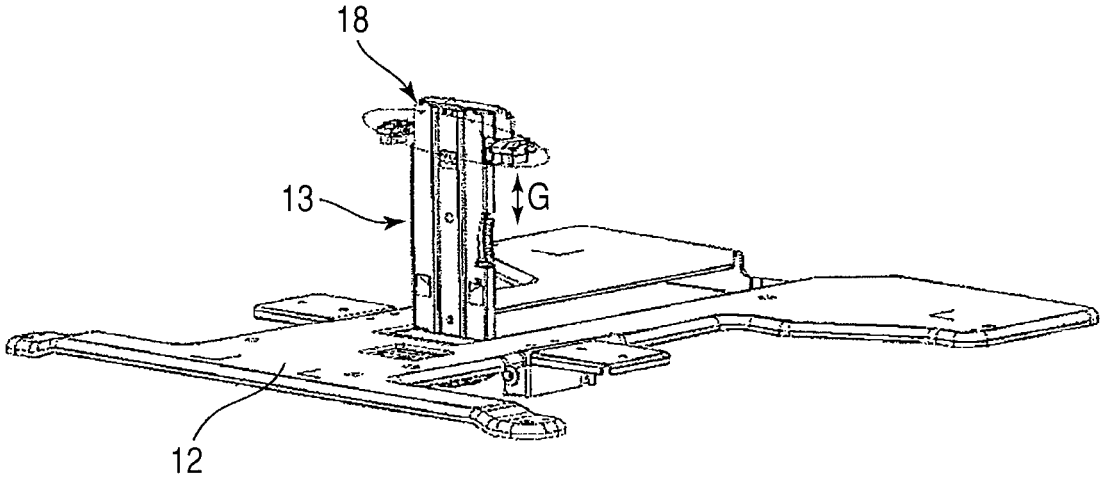
FIGS. 6A and 6B are diagrams illustrating details of a tray and a trailing edge regulation portion provided in the sheet feeding device provided in the image forming apparatus illustrated in FIG. 1.
Figure 6B:
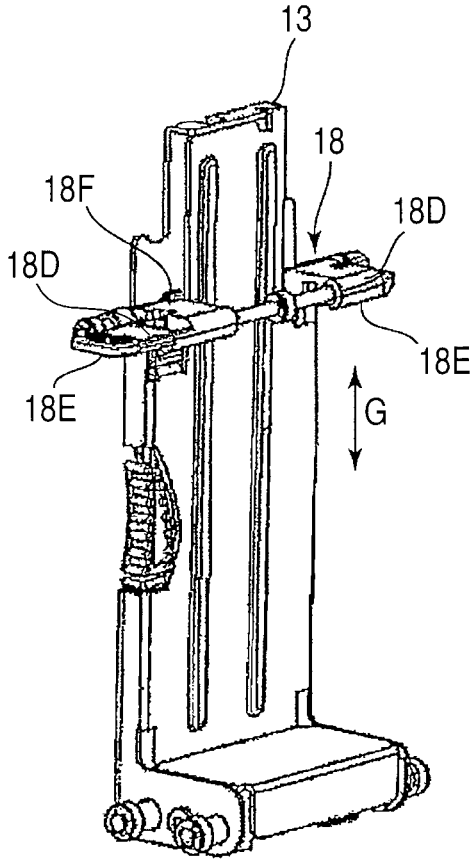

FIGS. 6A and 6B are diagrams illustrating details of the tray 12 and the trailing edge regulation portion 13. The trailing edge regulation portion 13 includes a trailing edge separating portion 18. The trailing edge separating portion 18 (shown in FIG. 6B) includes the above-mentioned protrusion 18D, a separation aid sheet 18E made of a material having a high friction coefficient, and a slider 18F that holds the protrusion 18D and the separation aid sheet 18E and is slidable in the direction indicated by the arrow G. Because the slider 18F is slidable along the length of the trailing edge regulation portion 13, the trailing edge separating portion 18 (including the protrusion 18D and sheet 18E) can be lifted and lowered together with the uppermost sheet so as to follow a movement of the top surface of the uppermost sheet securely.

Figure 7:
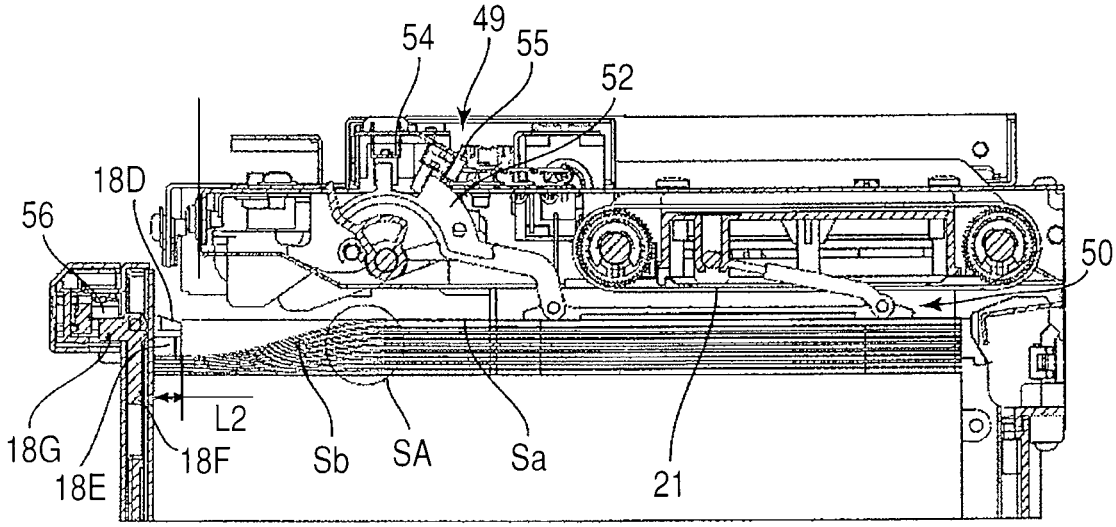
FIG. 7 is a diagram illustrating a structure of a sheet surface detection mechanism provided in the sheet feeding device provided in the image forming apparatus illustrated in FIG. 1.

In addition, as illustrated in FIG. 7, the slider 18F of the trailing edge separating portion 18 is provided with a trailing edge sheet surface detection sensor flag 18G. The trailing edge sheet surface sensor 56 provided in the trailing edge regulation portion 13 is turned on and off based on a position of the trailing edge sheet surface detection sensor flag 18G.

As will be described later, sheets are fed one by one so that the upper surface position of the stack of sheets is effectively lowered because there are fewer sheets left on the tray 12. When the upper surface position of the current uppermost sheet becomes lower than a regulated range (i.e. when the stack decreases in height to below a predetermined height or threshold), the trailing edge sheet surface sensor 56 is turned off by the trailing edge sheet surface detection sensor flag 18G that is lowered as the upper surface position of the stack of sheets is lowered. In this embodiment, the trailing edge regulation portion 13 is provided with the trailing edge sheet surface sensor 56 (that is a second sheet surface detection portion) configured to detect an upstream part (in the sheet feeding direction) of the upper surface of the current uppermost sheet among the sheets lifted by blown air. As a previous uppermost sheet is conveyed away from the pile of sheets S, the current uppermost sheet is the second sheet and is therefore also the sheet that is being detected by the second sheet surface detection portion 56. Therefore, sheets having different lengths in the sheet conveying direction may be used because the top surface of a subsequent sheet (no matter the length of the sheet) is measured, rather than a position of a leading or trailing edge. As all lengths of sheet have a top surface that can be detected, different lengths of sheet may be used in the same conveying system.

In this embodiment, as illustrated in FIG. 7, a sheet surface detection mechanism 49 is disposed above the tray, the sheet surface detection mechanism 49 including a sheet surface detection sensor flag 52, a first sheet surface sensor 54, a second sheet surface sensor 55 and a sensor flag mechanism 50. The control device 200 of FIG. 3 described above performs the lifting and lowering control of the tray 12 based on the turned-on and turned-off states of the first and the second sheet surface sensors 54 and 55 and the trailing edge sheet surface sensor 56. These three sensors are part of the sheet surface detection mechanism that is a "first sheet surface detection portion" configured to detect the upper surface of the uppermost sheet among the sheets lifted by the blown air. The first sheet surface sensor 54 detects whether the position of the uppermost sheet is lower than an appropriate range within which the suction conveyer portion 20 can apply suction to the sheet as described above. The second sheet surface sensor 55 detects whether the position of the uppermost sheet is higher than the same appropriate range. Together, the sheet surface sensors 54 and 55 determine whether the uppermost (or top) sheet is within the appropriate range.

Figure 8:
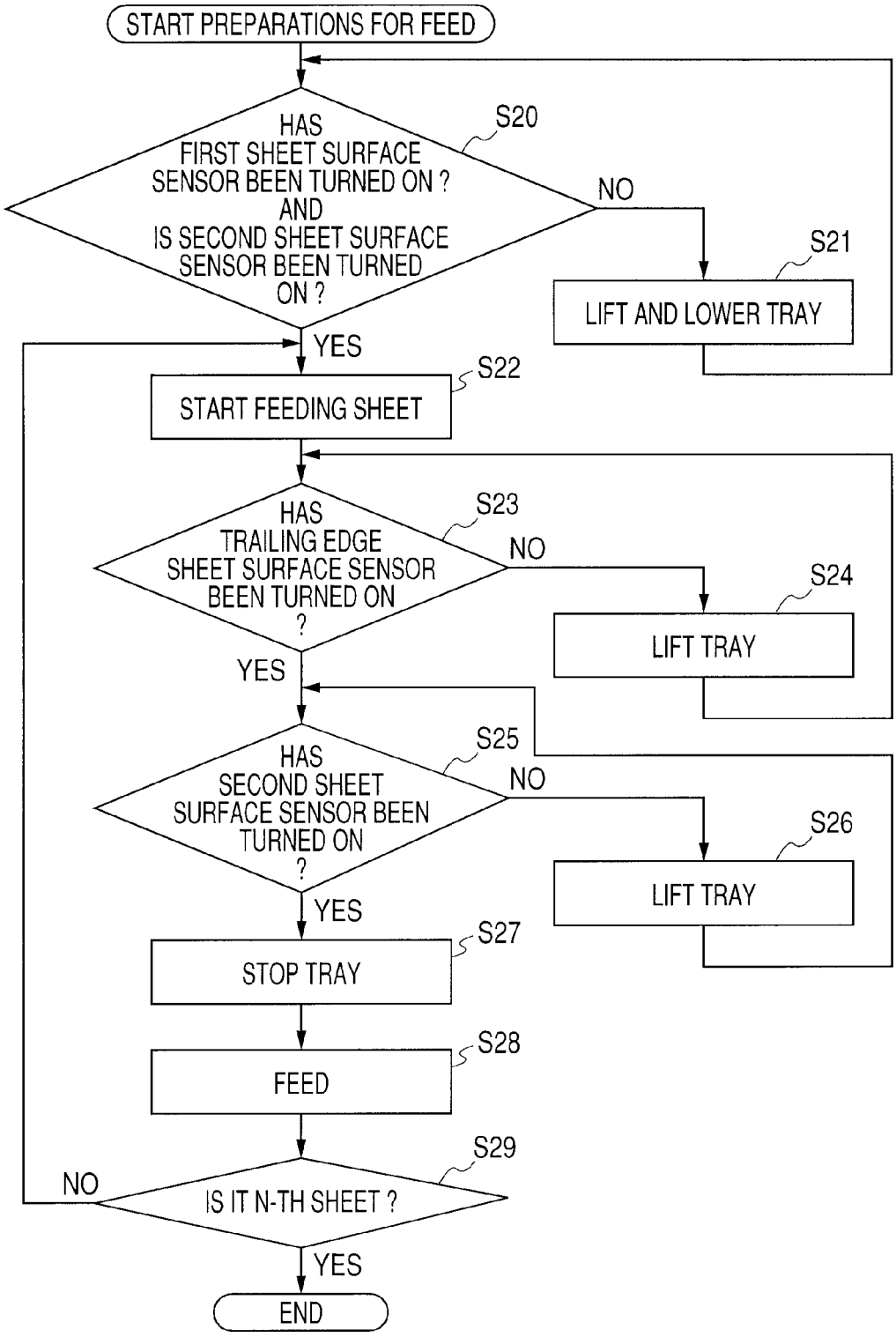
FIG. 8 is a flowchart illustrating lifting and lowering control of the tray provided in the image forming apparatus illustrated in FIG. 1.

Next, the lifting and lowering control of the tray 12 according to this embodiment will be described with reference to a flowchart illustrated in FIG. 8.

When receiving a feed start signal, the control device 200 starts preparation for feeding. First, rotation of the separation fan 31 is started, and air blowing is started, and sheets are lifted by the blown air. After that, based on the on/off signal from the first sheet surface sensor 54 and the second sheet surface sensor 55, the tray lifting and lowering drive motor M1 is driven so that the tray 12 is lifted and lowered.

Then, if the first and the second sheet surface sensors 54 and 55 are not caused to be turned on (e.g. because no signal is received) (NO in S20), the tray 12 is lifted and lowered (S21) appropriately as described above. If the first and the second sheet surface sensors 54 and 55 are caused to be turned on (e.g. by receiving a signal) (YES in S20), feeding of sheets is started (S22).

When the feeding of sheets is started, the uppermost sheet Sa is drawn up and fed by the suction conveyer belt 21. After that, when the uppermost sheet Sa is fed by the length of L2 (as illustrated in FIG. 7) or more, the trailing edge separating portion 18 drops so that a lower surface of the separation aid sheet 18E abuts a surface of the next sheet Sb.

The uppermost sheet Sa is fed, a position of the uppermost sheet is down so that the trailing edge sheet surface detection sensor flag 18G also drops. Soon afterward, the trailing edge sheet surface sensor 56 stops detecting the trailing edge sheet surface detection sensor flag 18G, and the trailing edge sheet surface sensor 56 is turned off. In other words, when sheets are fed so that the upper surface of the current uppermost sheet drops below a reference level, the trailing edge sheet surface sensor 56 outputs an OFF signal that is a detection signal indicating that the uppermost sheet among the air-lifted sheets is below the reference level. The trailing edge sheet surface sensor 56 determines whether the uppermost (or top) sheet is above the reference level.

Here, the OFF signal is output as described above when the uppermost sheet Sa passes the trailing edge separating portion 18. On this occasion, the sheet surface detection mechanism 49 is detecting the uppermost sheet Sa. However, in this embodiment, even if the sheet surface detection mechanism 49 is detecting the uppermost sheet Sa, the tray 12 is lifted when the trailing edge sheet surface sensor 56 becomes turned off. In other words, if the trailing edge sheet surface sensor 56 is turned on, the tray is lifted regardless of the signal from the first sheet surface detection portion.

Next, after the tray 12 is lifted in this way, it is determined whether or not the trailing edge sheet surface sensor 56 is caused to be turned on (S23). If the trailing edge sheet surface sensor 56 is not turned on (NO in S23), it is determined that the tray 12 is "too low", and the tray 12 is lifted until an ON signal is obtained (S24).

A distance by which the trailing edge side of the sheet can be lifted by the blown air is restricted to some extent by the weight of the trailing edge separating portion 18. Hence, the trailing edge side of the sheets is lower than the leading edge side, when the sheet is lifted by blown air. The appropriate range determined by the detection of the sheet surface sensors 54 and 55 is different position in a high direction from the reference level determined by the detection of trailing edge sheet surface sensor 56. The reference level is set lower than the appropriate range.

In this way, if the sheet is fed so that the level of the uppermost sheet is decreased, this is detected by the trailing edge sheet surface sensor 56 earlier than the sheet surface detection mechanism 49. When the suction conveyer belt 21 draws up the uppermost sheet, the drawn up sheet retracts the sheet surface detection member 61 upward to be housed in the holes 51H1 and 51H2. Therefore when the suction conveyer belt 21 conveys the uppermost sheet, the sheet surface detection mechanism 49 doesn't detect the subsequent sheet Sb. However shortly after the trailing edge portion of the sheet passes by the trailing edge sheet surface sensor 56, the trailing edge sheet surface sensor 56 can detect the subsequent sheet Sb. The trailing edge sheet surface sensor 56 detects the subsequent sheet Sb earlier than the sheet surface detection mechanism 49.

Therefore, if the lifting of the tray 12 is controlled based on the signal from the trailing edge sheet surface sensor 56, the tray 12 can be lifted and stopped earlier without having to make subsequent corrections, and hence throughput of the sheet feeding device is optimised. The tray 12 is controlled and lifted based on a lift amount that is set in advance based on information such as thickness of the sheet when the lifting of the tray 12 is started based on the signal from the trailing edge sheet surface sensor 56 so as to lift the tray 12.

The sheet surface detection mechanism 49 checks whether or not the leading edge of the uppermost sheet is lifted by blown air within a predetermined region when the suction conveyer belt 21 dose not convey the sheet.

Therefore, if the trailing edge sheet surface sensor 56 is turned on (YES in S23), it is determined next whether or not the uppermost sheet position is in the appropriate range based on the signal from the second sheet surface sensor 55. If the second sheet surface sensor 55 is not turned on (NO in S25), the tray 12 is lifted (S26) until the second sheet surface sensor 55 is turned on (YES in S25).

Further, if the sheet surface on the leading edge side is out of the predetermined region despite the ON signal being obtained from the trailing edge sheet surface sensor 56, i.e., if the second sheet surface sensor 55 is turned off (NO in S25), the tray 12 is lifted (S26). However, in this case too, the tray 12 (the uppermost sheet) is already lifted to the level that enables the trailing edge sheet surface sensor 56 to output the ON signal, and hence it does not take such a length of time that may affect throughput.

Next, when the second sheet surface sensor 55 is turned on (YES in S25), the tray 12 is stopped (S27) and afterward the feeding of sheets is started (S28). If N sheets are stacked on the tray 12, the above-mentioned control is repeated until the $N^{th}$ sheet is fed. When the $N^{th}$ sheet is fed (YES in S29), the feeding operation is stopped.

Thus, in this embodiment, if the trailing edge sheet surface sensor 56 detects that the uppermost sheet is lower than the reference level when the sheet passes, the tray 12 is controlled to be lifted. Thus, any number and size of sheet can be fed without reducing the throughput of the sheets.

Further, if this structure is adopted, it is sufficient that the trailing edge sheet surface sensor 56 detects at least the state where the uppermost sheet is "too low" when the sheets are fed successively. Thereafter, when the uppermost sheet is no longer "too low", the tray lifting can automatically stop. Therefore, the structure can be simpler than one including the sheet surface detection mechanism 49, by only including a trailing edge sheet surface sensor 56. As a result, the trailing edge sheet surface sensor 56 can easily be disposed inside the trailing edge regulation portion.

In addition, in order that the uppermost sheet is positioned within the appropriate range, it is possible to provide a plurality of trailing edge sheet surface sensors so that the detection positions for generating level insufficiency signals can be switched, and to perform the sheet surface level control of the trailing edge portion by the plurality of positions. Thus, the structures are applicable to the case where a difference between a sheet surface level on the leading edge side and sheet surface level on the trailing edge side exists depending on various weights or sizes of the sheets. Thus, it is possible to achieve a more stable state of sheets being lifted by the blown air, and hence occurrence of feeding more than one sheet or jamming of a sheet can be better prevented.

A blowing state of sheet-loosening air or sheet-separation air may change during the time within which the suction conveyer belt draws up the uppermost sheet, or during a very short time between when the feeding of the uppermost sheet starts and when the trailing edge separating portion 18 abuts the surface of the next sheet. Thus, if the blowing state changes in this way, a lifted and separated state of the sheets on the leading edge side or the trailing edge side is disturbed. As a result, the separation between sheets may become insufficient, resulting in the feeding of more than one sheet or jamming of a sheet. In addition, the lifting and separating state of the sheets may be disturbed depending on characteristics of the sheet, resulting in the same problem.

Figure 9A:
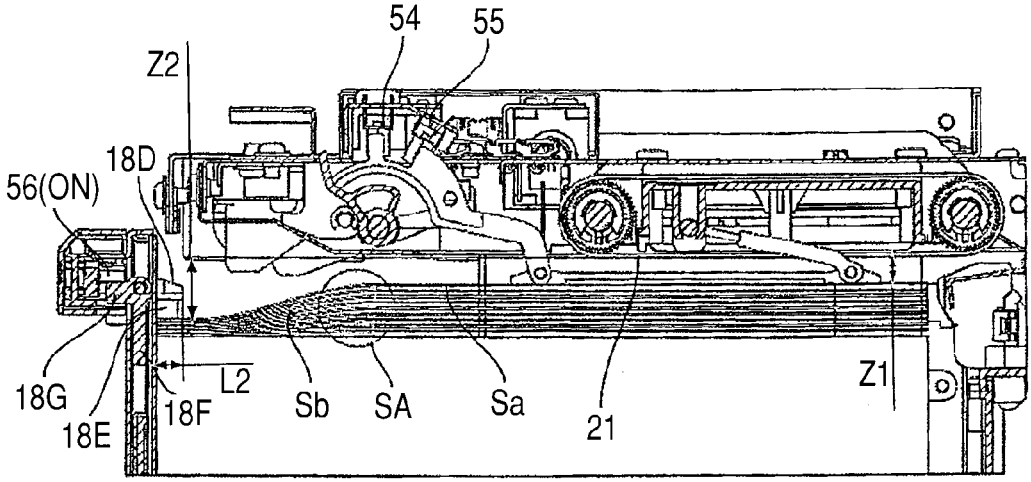
FIGS. 9A and 9B are diagrams illustrating states during the sheet feeding operation of the sheet feeding device provided in the image forming apparatus illustrated in FIG. 1.
Figure 9B:
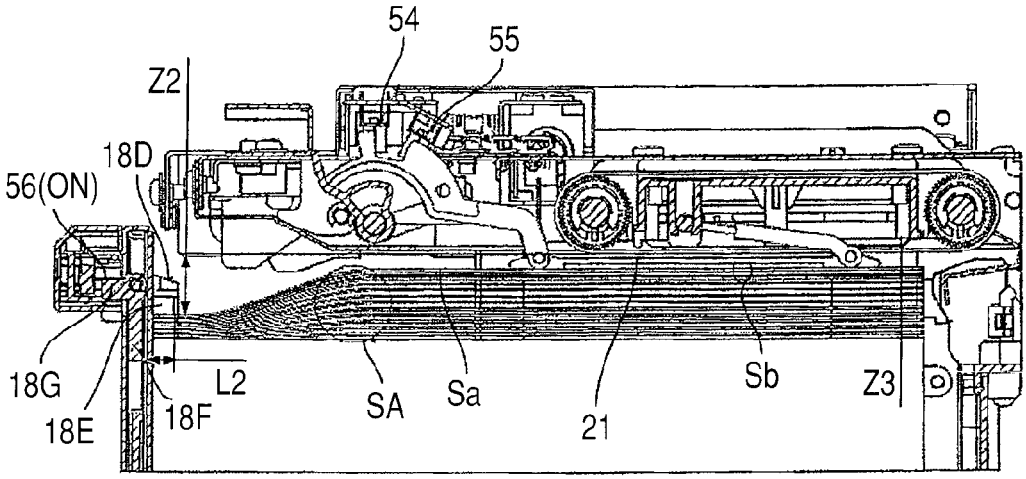

FIGS. 9A and 9B are diagrams illustrating a sheet that is being lifted by the blown air and fed into the image-forming apparatus. FIG. 9A illustrates a desired state of the sheet that is being conveyed while FIG. 9B illustrates an undesirable state of the sheet that is being conveyed.

In the preferable state of the sheets illustrated in FIG. 9A, the trailing edge sheet surface sensor 56 is caused to be turned on and the tray (not shown) is stopped. In this case, a distance between the suction conveyer belt 21 and the leading edge side of the uppermost sheet Sa is Z1, while a distance between the trailing edge side of the uppermost sheet Sa and the suction conveyer belt 21 is Z2. The sheet stack SA is lifted with blown air substantially uniformly, and hence the separation is performed appropriately. In addition, a distance Z1 between the suction conveyer belt 21 and the uppermost sheet Sa is steady, and hence the separation air enters between the uppermost sheet Sa and the immediately subsequent sheet Sb after the uppermost sheet Sa is drawn up. Thus, the feeding out of more than one sheet can be prevented.

In the undesirable state illustrated in FIG. 9B, the position of the trailing edge of the uppermost sheet Sa is not different from the position in FIG. 9A. Although the distance between the suction conveyer belt 21 and the trailing edge side of the uppermost sheet Sa is also Z2, the distance between the leading edge side of the uppermost sheet Sa and the suction conveyer belt 21 is Z3, which is less than Z1. Furthermore, the uppermost sheet Sa is lifted together with the immediately subsequent sheet Sb as a sheet bundle. In this state, the separation between the sheets may become insufficient so that the feeding of more than one sheet can easily occur. Even if uniform separation of sheets can be obtained in this state, the separation air cannot enter appropriately between sheets because the distance Z3 on the leading edge side is too small. Therefore, the likelihood of feeding more than one sheet might be increased.

Such an undesirable state occurs in the case where the sheet type is thick and has less flexibility, for example. In other words, if the sheet is thick and has less flexibility, the difference between Z2 and Z1 (or Z2 and Z3) is not as large as illustrated in FIGS. 9A and 9B when the sheet is separated and lifted by the blown air. As a result, a thin air layer is generated between sheets also on the trailing edge side. On the other hand, because of being distant from the leading edge side, the loosening air for sustaining the blown-up state might not enter very far between the sheets. Therefore, a small vibration may occur in the horizontal direction.

In this state, the trailing edge sheet surface sensor 56 may be turned on and off frequently. Then, despite the leading edge side being appropriately positioned, the tray may be lifted excessively depending on a result of the detection of the sheet surface on the trailing edge side.

In addition, if the sheet has a thickness of approximately 0.1 mm or less, and if the trailing edge sheet surface sensor 56 has an error of approximately 1 mm as an accumulation of dimension errors of components constituting the trailing edge sheet surface sensor 56, ten or more sheets may be lifted by the blown air as a sheet bundle. It is thus very important to consider factors of the dimensional errors of the components of the sheet lifting and conveying system.

Further, even if the dimensional errors of the components are controlled, a thin sheet can naturally be loosened easily due to characteristics (i.e. low weight) of the thin sheet. If the sheets are loosened more than initially envisioned while the sheets are fed, the sheets may enter a state in which the trailing edge sheet surface sensor 56 alternates between on and off irregularly. In this case, too, unnecessary lifting of the tray may be performed similarly to the case of the thick sheet, and its influence is even larger than that in the case of the thick sheet. In the case of the thin sheet, the number of sheets lifted as a sheet bundle may increase, and the feeding of more than one sheet or jamming of a sheet may occur.

In order to prevent the above risks, in this embodiment, when a time limit lapses after the start of the conveyance of the sheets, i.e., after the checking of the sheet surface position, the tray 12 is stopped. Here, FIGS. 10A and 10B illustrate a change in position of the sheet surface on the trailing edge side of the sheet and the signal of the trailing edge sheet surface sensor 56 in the case where the tray 12 is stopped after a time lapse from the start of feeding of the sheet.

Figure 10A:
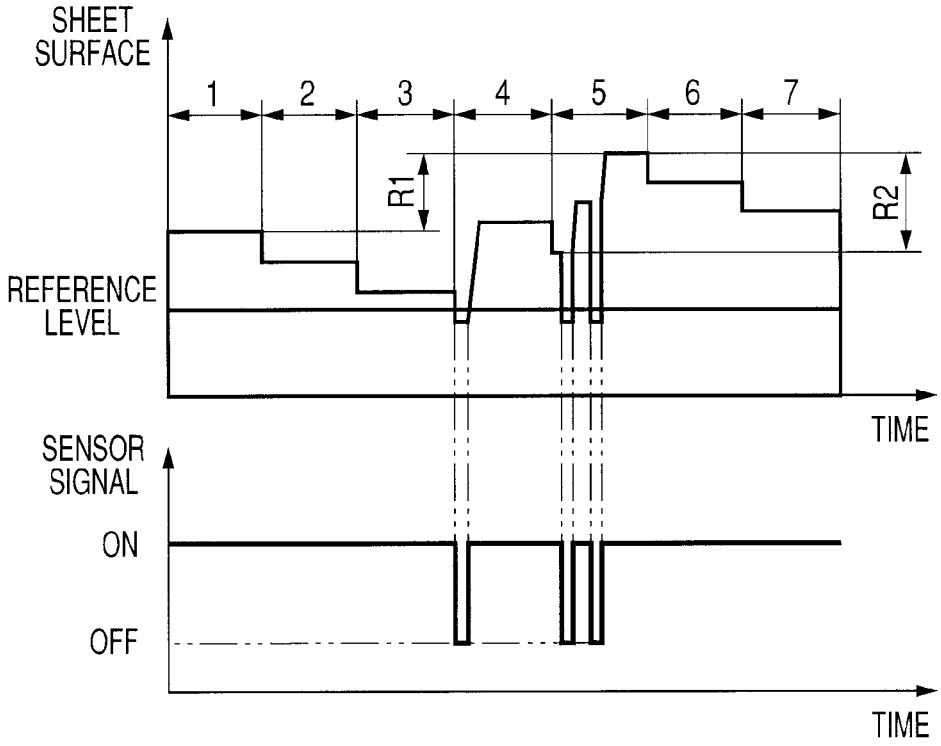
FIGS. 10A and 10B are diagrams illustrating sheet surface control of the sheet feeding device provided in the image forming apparatus illustrated in FIG. 1.
Figure 10B:
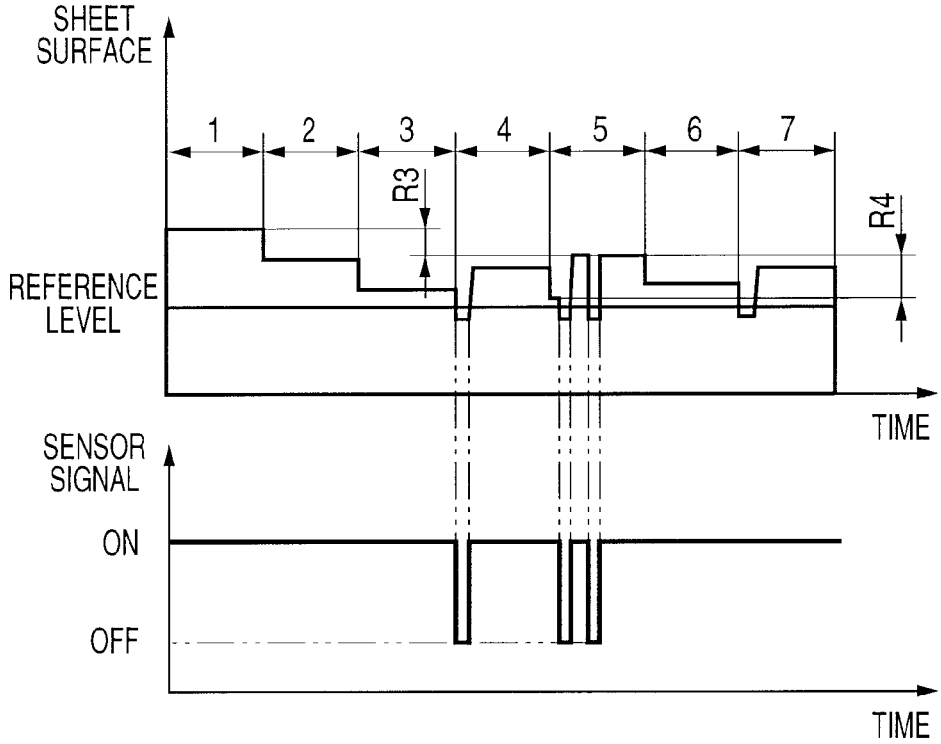

FIG. 10A illustrates conventional control of the blown air while FIG. 10B illustrates a case of the control according to this embodiment. In the conventional control illustrated in FIG. 10A, as a sheet-feeding operation is started so that a first sheet, a second sheet, and then a third sheet are fed into the image-forming apparatus, the surface of the remaining sheets is gradually lowered toward a reference level. The sheet numbers are shown as integers 1 to 7 on FIG. 10A. When the feeding of a third sheet is finished and the trailing edge separating portion contacts a surface of a fourth sheet, the fourth sheet surface is lower than the reference level. At this time, the signal from the trailing edge sheet surface sensor 56 changes from ON to OFF, as shown in the bottom graph of FIG. 10A. Of course, the reference level may be after any predetermined decrease in height of the stack level (and thus after the feeding of any number of sheets, not just three).

When the signal from the trailing edge sheet surface sensor 56 changes in this way, the lifting of the tray 12 is started so that the fourth sheet becomes the same level as the first sheet was a the beginning of the sheet feeding. However, because the sheet is in a state where it is lifted from the surface of the tray by the action of the blown air between the sheets, the sheet surface is not lifted at the same time as the tray 12 starts to be lifted. There is a delay between the tray being raised and the sheets that are lifted by the blown air also being raised because of the cushion of air between sheets being compressed. The lifting of the tray 12 first causes a change in the air cushion thickness on the leading edge side.

The blowing states (i.e. air pressure) of the sheet-loosening air and the sheet-separation air change because of the change in the air cushion thicknesses and resistance in the air flow. This causes the sheet surface to start to be lifted after a delay time. Therefore, even if the signal from the trailing edge sheet surface sensor 56 changes from OFF to ON so that the tray is stopped after that, the sheet surface continues to be lifted for a short time depending on the air flow D, E from the air input fan 31.

This lifting of the sheet surface by the tray may cause disturbance of the air cushion under the sheet after the trailing edge portion of the sheet passes by the trailing edge sheet surface sensor 56. This disturbance of the air cushion under the sheet disappears substantially instantly, and the sheet surface is restored to being higher than the reference level. Therefore, it is intrinsically unnecessary to lift the tray 12 as much as it is lifted, but the signal from the trailing edge sheet surface sensor 56 may change from ON to OFF if the air cushion is disturbed. Then, if the signal from the trailing edge sheet surface sensor 56 changes, the tray 12 is already raised by time of the change and has potentially gone too high.

For instance, as illustrated in FIG. 10A, when the tray 12 is lifted, the fourth sheet becomes the same level as that of the first sheet and is fed into the feeding or conveying apparatus. Then, a fifth sheet starts to be fed. At this time, if a disturbance of the air cushion occurs twice, the signal from the trailing edge sheet surface sensor 56 also changes twice. Then, if such a signal change occurs twice, a deviation from an original level of the sheet surface becomes R2 in FIG. 10A, which is higher than the level when the feeding was started by R1 in FIG. 10A. If the level of the sheet surface becomes too high, the feeding of more than one sheet or other trouble may occur. Such the disturbance in the air cushion between sheets occurs unexpectedly depending on type or state of the sheets.

In contrast, in the present embodiment, when the conveyance of the fourth sheet is performed, the tray 12 is stopped at the position where the fourth sheet is lower than the first sheet so that at least the fourth sheet can be drawn up and conveyed at the timing when the signal from the trailing edge sheet surface sensor 56 changes to ON. In other words, after the signal from the trailing edge sheet surface sensor 56 changes to OFF so that the tray 12 is lifted, the tray 12 is stopped if a time limit lapses, even if the trailing edge sheet surface sensor 56 does not change to ON. This time limit is, for example, a time necessary for lifting the fourth sheet to a position that is lower than that of the first sheet so that at least the fourth sheet can be drawn up and conveyed as illustrated in FIG. 10B.

In this way, in the stage of changing from the third sheet to the fourth sheet, the tray 12 is stopped at the position where at least the fourth sheet can be suctioned and conveyed, allowing for a delayed raising of the rest of the sheets caused by compression of the air cushions between the sheets. By the time the fourth sheet has been conveyed away, the fifth sheet has equalised its air cushion level and is ready to be conveyed, too. Thus, the influence of the disturbance of the air cushions can be reduced. In other words, the trailing edge sheet detection sensor 56 overrides to a certain extent the leading edge sheet surface sensor 49.

As a further example, as illustrated in FIG. 10B, if the air cushion is disturbed twice similarly to the case of FIG. 10A after changing to the fifth sheet, the tray 12 is lifted in the first disturbance similarly to the case of FIG. 10A. However, if the signal from the trailing edge sheet surface sensor 56 changes from OFF to ON, the tray 12 is stopped so that the lift amount of the sheet surface is restricted. Thus, deviation of the level from the original level of the sheet surface can be controlled to be R4 in FIG. 10B. In addition, the tray 12 is not lifted in the second disturbance because the tray 12 has reached an upper limit of the lift amount in the first disturbance. As a result, the tray 12 is controlled to be the position lower than the level when the feeding was started by R3 in FIG. 10B. As a maximum level, the tray 12 could be moved to a position that is the same as when the feeding was started.

Figure 11:
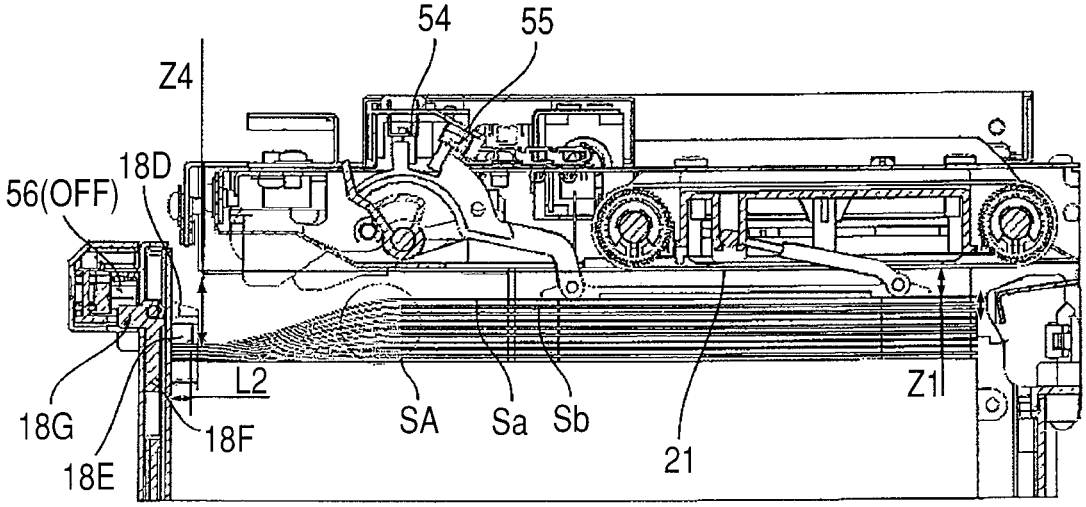
FIG. 11 is a diagram illustrating a turned-off state of a trailing edge sheet surface sensor provided in the sheet feeding device of the image forming apparatus illustrated in FIG. 1.

In this way, unnecessary lifting of the tray 12 is prevented by restricting the lift amount of the tray 12 after the trailing edge sheet surface sensor 56 is turned OFF while the tray 12 is moving upward. This OFF state of the trailing edge sheet surface sensor 56 is illustrated in FIG. 11.

This restriction of the lift amount is performed for each of the sheets. In other words, the restriction of the lift amount is temporarily cancelled when the object being controlled changes to the next sheet. Thus, optimal control can be performed for each sheet. Here, control of "one of sheets" may be defined as a time period between start timings to rotate the suction conveyer belt for feeding a first sheet and the next sheet. In addition, it may also be defined as a time period between ON signals from the first and the second sheet surface sensors 54 and 55 that are nearest to a suction area obtained by feeding the sheet, or a time period between start timings to activate a suction shutter solenoid SL configured to rotate the suction shutter 37.

Figure 12:
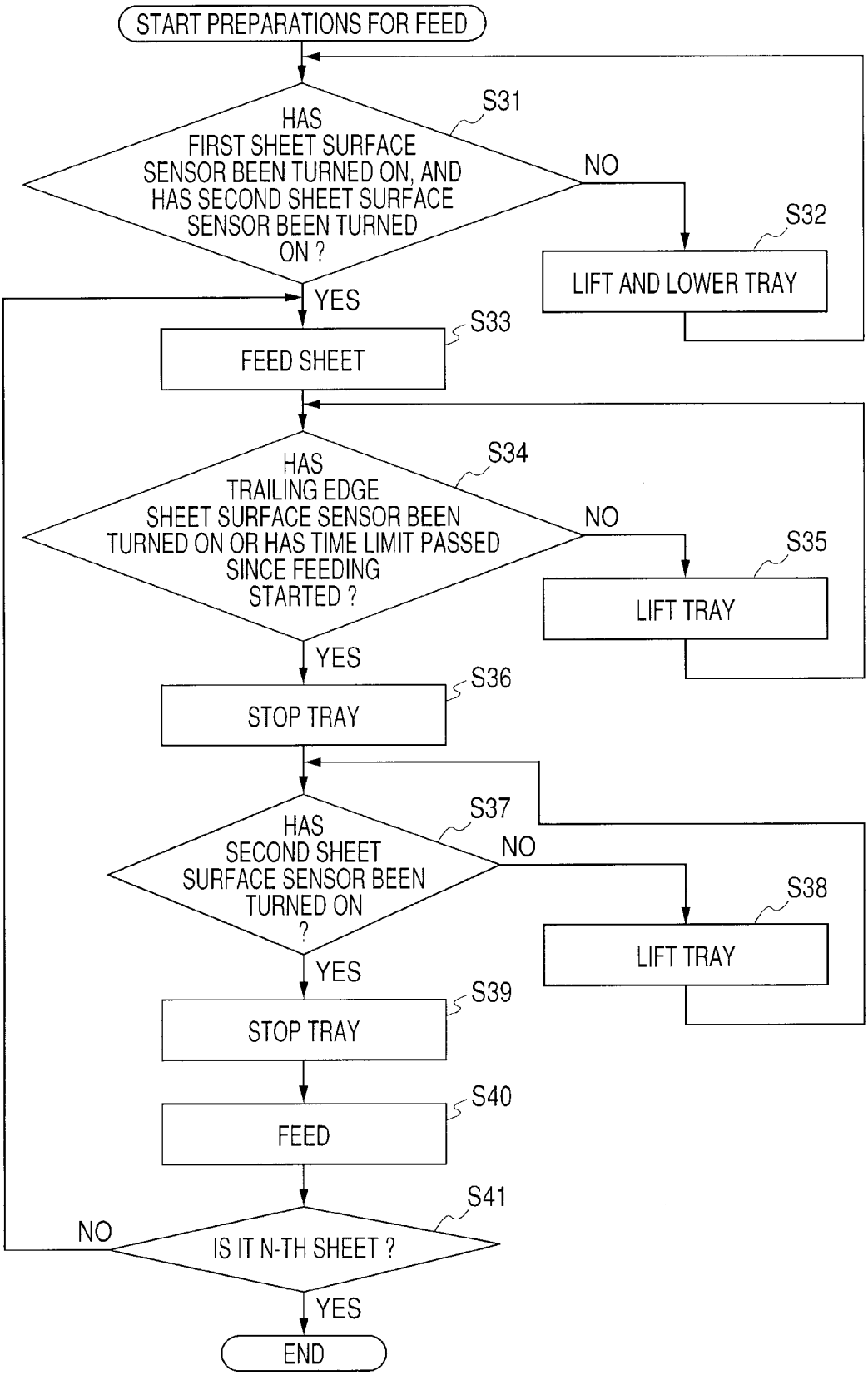
FIG. 12 is a flowchart illustrating lifting and lowering control of the tray provided in the image forming apparatus illustrated in FIG. 1.

Next, the lifting and lowering control of the tray 12 will be described with reference to a flowchart illustrated in FIG. 12.

When receiving a feed start signal, the control device 200 starts preparation for feeding. First, rotation of the separation fan 31 is started, and air blowing is started, and hence sheets are lifted by air cushions separating them. After that, if the first sheet surface sensor 54 or the second sheet surface sensor 55 is not turned on (NO in S31), the tray 12 is lifted and lowered (S32) as required. When the first and the second sheet surface sensors 54 and 55 are turned on (YES in S31), feeding of the sheet is started (S33).

Next, when the feeding of sheets is started, the uppermost sheet Sa is drawn up and fed by the suction conveyer belt 21. After that, when the sheet Sa is fed by the length of L2 (as illustrated in FIG. 7) or more, the trailing edge separating portion 18 drops so that a lower surface of the separation aid sheet 18E abuts a surface of the next sheet Sb.

When the trailing edge separating portion 18 drops every time the uppermost sheet Sa is fed, the trailing edge sheet surface detection sensor flag 18G is also lowered along therewith. Soon afterward, the trailing edge sheet surface sensor 56 no longer detects the trailing edge sheet surface detection sensor flag 18G, and hence the trailing edge sheet surface sensor 56 is turned off. When the trailing edge sheet surface sensor 56 is turned off, the tray 12 is lifted.

Next, it is determined whether or not the trailing edge sheet surface sensor 56 is turned back on. If the trailing edge sheet surface sensor 56 is still turned OFF, it is determined that the level is still "too low", and the tray 12 is lifted.

Subsequently or alternatively, it is determined whether or not the trailing edge sheet surface sensor 56 is turned on, or whether a time limit has lapsed from the start of feeding sheets (S34). Here, if the trailing edge sheet surface sensor 56 is not turned on, or if the time limit has not lapsed from the start of feeding sheets (NO in S34), the tray 12 continues to be lifted (S35).

After that, when the trailing edge sheet surface sensor 56 is turned on, or when the time limit has lapsed from the start of feeding sheets (YES in S34), the tray 12 is stopped (S36). When the tray 12 is stopped at this timing, the sheet is lifted and is stopped at the position where the first sheet can be drawn up and conveyed as illustrated in FIG. 10B, for example. Thus, the sheet can be fed. In addition, by stopping the action of lifting the tray 12 so as to restrict the total lift amount of the tray 12, it is possible to prevent the tray 12 from being lifted too high even if the trailing edge sheet surface sensor 56 repeats OFF and ON frequently afterward.

When the feeding of the sheet is started after that, the position control of the uppermost sheet is performed mainly based on the trailing edge sheet surface sensor 56. Therefore, it is sufficient for the sheet surface detection mechanism 49 for detecting the sheet surface on the leading edge side to check whether or not the uppermost sheet is lifted by the blown air in a predetermined region.

Therefore, if the trailing edge sheet surface sensor 56 is turned on, it is determined next whether or not the uppermost sheet position is in the reference level (for the uppermost sheet to be drawn up and conveyed by the suction conveyer belts 21) based on the signal from the second sheet surface sensor 55. In other words, if the second sheet surface sensor 55 is not turned on (NO in S37), the tray 12 is lifted (S38) until the second sheet surface sensor 55 is turned on (YES in S37).

Further, if the sheet surface on the leading edge side is out of the predetermined region despite the ON signal being obtained from the trailing edge sheet surface sensor 56, i.e., if the second sheet surface sensor 55 is turned off (NO in S37), the tray 12 is lifted (S38). However, in this case too, the tray 12 (and therefore the uppermost sheet) is already lifted to the level that enables the trailing edge sheet surface sensor 56 output the ON signal, and hence it does not take such a long time to lift the sheet that throughput would be affected.

Next, when the second sheet surface sensor 55 is turned on (YES in S37), the tray 12 is stopped (S39) and afterward the feeding of sheets is started (S40). If N sheets are stacked (supported) on the tray 12, the above-mentioned control is repeated until an $N^{th}$ sheet is fed. When the $N^{th}$ sheet is fed (YES in S41), the feeding operation is stopped.

In this way, in this embodiment, unnecessary lifting of the tray 12 is prevented by stopping the lifting of the tray 12 when the trailing edge sheet surface sensor 56 is turned off as illustrated in FIG. 11. Furthermore, by restricting the lift amount, unnecessary lift of the tray 12 is not performed even if the trailing edge sheet surface sensor 56 alternates between OFF and ON frequently. Thus, an equilibrium state in air cushions between the sheets can be sustained.

The time limit during which the tray 12 is lifted may be counted by a timer, for example. It is desired that the time limit should be set to a value for realizing the optimal equilibrium state of the air cushions depending on a type, basic weight and a size of sheets, and can be changed during the feeding process of the sheets. In this embodiment, the time limit is set to 40 ms in the case of thin sheets and to 100 ms in the case of thick sheets.

In addition, the lift amount of the tray 12 is restricted based on timing counted by a timer or the like in the above description, but the present invention is not limited to this. For instance, the amount of rotation (number of pulses) of the tray lifting and lowering drive motor M1 or a rotation angle may be monitored for deciding the restriction. Further, the restriction of the lift amount should be performed so that the throughput of sheets is not lowered and the equilibrium state of the sheets floating on respective air cushions is obtained. If it is difficult to achieve both throughput and an equilibrium state, fine setting should be performed in accordance with a type, basis weight, size, etc. of the sheets.

Furthermore, the sheet feeding device 103 of the present invention can be used for an image forming apparatus having an image forming portion 102 and a sheet treating apparatus configured to treat the sheets on which images are formed by the image forming portion 102.

While the present invention has been described with reference to exemplary embodiments, it is to be understood that the invention is not limited to the disclosed exemplary embodiments, but rather to the scope of the following claims.

This application claims the benefit of Japanese Patent Application No. 2009-020824, filed on Jan. 30, 2009, which is hereby incorporated by reference herein in its entirety.

What is claimed is:

1. A sheet-feeding device configured to feed sheets, the sheet feeding device comprising:

a tray configured to support a stack of sheets;

a lifting and lowering portion configured to lift and lower the tray;

a control portion configured to control the lifting and lowering portion;

an air blowing portion configured to blow air at an end of the stack of sheets to blow upward the stack of sheets;

a suction conveyer configured to draw up and convey a top sheet blown upward by the air blown by the air blowing portion; and a first detection portion configured to detect the upper surface of the top sheet blown upward by the air blown by the air blowing portion, wherein the control portion is configured to control the lifting and lowering portion based on an output of the first detection portion so that the top sheet, blown upward by the air blown by the air blowing portion, of the stack of sheets is positioned in a conveyance range in which the suction conveyer can convey the top sheet; and a second detection portion configured to detect the upper surface of a trailing end portion of the stack of sheets, wherein the second detection portion detects an upper surface of a subsequent sheet, which is conveyed next to the top sheet, after the top sheet is conveyed by the suction conveyer, and when the control portion determines that the subsequent sheet is lower than a predetermined level in which the suction conveyer can convey the subsequent sheet, based on an output of the second detection portion during conveyance of the top sheet by the suction conveyor, the control portion controls the lifting and lowering portion so that the lifting and lowering portion lifts the tray until the upper surface of the subsequent sheet is above the predetermined level, and when the control portion determines that the subsequent sheet is positioned above the predetermined level based on the output of the second detection portion and the control portion determines that the subsequent sheet blown upward by the air blown by the air blowing portion is lower than the conveyance range based on an output of the first detection portion after the top sheet has been conveyed, the control portion controls the lifting and lowering portion so that the lifting and lowering portion lifts the tray until the subsequent sheet is positioned in the conveyance range.

2. A sheet-feeding device according to claim 1, further comprising a regulation portion configured to regulate a position of the stack of sheets by abutting the trailing edge of the sheets stacked on the tray, wherein the second detection portion is provided on the regulation portion.

3. A sheet-feeding device according to claim 2, wherein the second detection portion comprises:

a flag provided on the regulation portion and configured to abut the upper surface of the sheets stacked on the tray; and a slider configured to attach the flag to the regulation portion to lift and lower the flag integrally with the top sheet as it is separated and lifted from the stack of sheets by the blown air from the air blowing portion; and a sensor provided on the regulation portion and configured to generate a detection signal according to a position of the flag.

4. A sheet-feeding device according to claim 1, wherein the control portion is configured to control the lifting and lowering portion such that when the tray is lifted based on the output from the second detection portion, the tray is lifted by a preset amount that is based on characteristics of the sheets.

5. A sheet-feeding device according to claim 4, wherein, while the tray is being lifted by the preset amount, if the first detection portion outputs a signal indicating that the top sheet has reached the conveyance range, the control portion is configured to control the lifting and lowering portion to stop the lifting of the tray.

6. A sheet-feeding device according to claim 1, wherein the first detection portion comprises:

a first sheet surface sensor configured to detect whether a position of the top sheet is lower than the conveyance range; and a second sheet surface sensor configured to detect whether the position of the top sheet is higher than the conveyance range, and wherein the control portion is configured to control the lifting and lowering portion based on signals from the first sheet surface sensor and the second sheet surface sensor such that the top sheet is positioned within the conveyance range.

7. A sheet-feeding device according to claim 6, wherein the control portion is configured to control the lifting and lowering portion such that the tray is lifted until the top sheet reaches the conveyance range and is drawn up and conveyed, and thereafter, if it is determined based on a detection of the first sheet surface sensor that the upper surface of the top sheet is too low, the lifting and lowering portion is configured to lift the tray so that the top sheet is positioned within the conveyance range.

8. A sheet-feeding device according to claim 1, wherein the predetermined level of the upper surface of the trailing end portion of the stack of sheets corresponds to a position where the top sheet of the stack of sheets is or will be in the conveyance range when the top sheet is separated and lifted from the stack of sheets by the air blowing portion.

9. A sheet-feeding device according to claim 1, wherein the control portion is configured to control the lifting and lowering portion to lift the tray based on the output from the second detection portion until the top sheet lifted and separated by the air blown from the air blowing portion reaches the conveyance range, and thereafter to stop the movement of the tray until a subsequent sheet to be drawn up and conveyed by the suction conveyer is detected by the second detection portion, the tray being not lifted even if the second detection portion detects that the upper surface of the trailing end portion of the stack of sheets is below the predetermined level.

10. An image forming apparatus comprising a sheet-feeding device according to claim 1.

* * * * *